United States Patent [19]

Best

[11] Patent Number: 5,062,788

[45] Date of Patent: Nov. 5, 1991

[54] HIGH EFFICIENCY LINEAR GAS BURNER ASSEMBLY

[75] Inventor: Willie H. Best, Columbia, S.C.

[73] Assignee: Haden-Schweitzer Corporation, Madison Heights, Mich.

[21] Appl. No.: 647,173

[22] Filed: Jan. 24, 1991

Related U.S. Application Data

[63] Continuation of Ser. No. 295,264, Jan. 10, 1989, abandoned.

[51] Int. Cl.[5] ..... F23D 14/12

[52] U.S. Cl. ..... 431/7; 431/10; 431/354; 431/326; 431/328

[58] Field of Search ..... 431/2, 7, 10, 12, 326, 431/328, 329, 346, 354

[56] References Cited

U.S. PATENT DOCUMENTS

| | | | |
|---|---|---|---|
| 2,494,243 | 1/1950 | Hovlis | 431/354 X |
| 2,618,539 | 11/1952 | Conta et al. | 431/346 X |
| 3,080,912 | 3/1963 | Winter | 431/346 X |
| 3,695,818 | 10/1972 | Mizutani | 431/328 |
| 3,715,183 | 2/1973 | Manifold | 431/328 |
| 3,736,095 | 5/1973 | Leatherby | 431/328 X |
| 4,039,275 | 8/1977 | McGettrick | 431/329 |
| 4,235,023 | 11/1980 | Best | 34/31 |
| 4,546,553 | 10/1985 | Best | 34/39 |
| 4,752,213 | 6/1988 | Grochowski et al. | 431/328 |
| 4,785,552 | 11/1988 | Best | 34/30 |

FOREIGN PATENT DOCUMENTS

| | | | |
|---|---|---|---|
| 736283 | 6/1966 | Canada | 431/346 |
| 875920 | 7/1971 | Canada | 431/328 |
| 0235789 | 9/1987 | European Pat. Off. | 431/354 |
| 0309838 | 4/1989 | European Pat. Off. | 431/5 |
| 1158822 | 5/1985 | U.S.S.R. | 431/10 |
| 2196103 | 4/1988 | United Kingdom | 431/5 |

*Primary Examiner*—Carl D. Price

*Attorney, Agent, or Firm*—Hurt, Richardson, Garner, Todd & Cadenhead

[57] ABSTRACT

A high efficiency linear gas burner assembly having a mixture manifold assembly for delivering a combustible gas and air mixture to a burner. The mixture manifold assembly supports an elongate, channel-shaped, secondary air plenum which receives therein a burner housing. The burner housing supports two, spaced, parallel plates, each having apertures therethrough. The gas/air mixture is delivered through the mixture manifold assembly and secondary air plenum to the burner housing where the mixture passes first through the apertures of the lower plate, then between the plates, then through the apertures of the upper plate or burner surface. The size and number of apertures in the upper plate and the space between the plates ensures that the flame remains stable during a wide range of turndown, and that the flame does not retrogress through the burner apertures. Secondary air ports are provided along the interior of the secondary air plenum to provide additional air for combustion.

29 Claims, 6 Drawing Sheets

HIGH EFFICIENCY LINEAR GAS BURNER ASSEMBLY

This is a continuation of copending application Ser. No. 07/295,264, filed on Jan. 10, 1989, now abandoned.

BACKGROUND OF THE INVENTION

1. Field of the Invention

This invention relates to a linear-type burner assembly capable of discharging uniform heat over a long span, and is more particularly concerned with a burner assembly that has high combustion efficiency and requires minimum excess air for combustion. The burner assembly's design will not allow flame retrogression through the burner apertures, even under extreme operating conditions, which normally would have resulted in flashback in the mixture manifold. The burner can be operated at any angle around its longitudinal axis, while maintaining stable combustion.

2. Description of the Prior Art

There are many types of gas burners used in industrial heat processing, including packaged burners, air stream burners (make-up air type) and line burners. With the exception of line burners, most industrial type burners are rated at 500,000 BTUH or higher. For the present intended use of these types of burners, it is usually advantageous to keep the maximum input as high as practical and still achieve complete combustion. In most oven applications, a recirculating air system is used to distribute the heat energy from these high BTUH burners to the oven environment. In other words, in most burners of today's technology there is a concentrated discharge of energy and a means must be provided independently from the combustion air supply to the burner to uniformly distribute the energy.

An example of a present line burner is the LINO-FLAME TM gas burner manufactured by the Maxon Corporation. These burners utilize a gas/air manifold that is an integral part of the burner structure. The sections of these burners are intended to be assembled together, and the total amount of the gas/air mixture required downstream of any burner must pass through the manifold of that burner. Therefore, it is not practical to assemble these types of burners in lengths longer than 7 ft. to 10 ft. because of the high mixture velocity which would affect the distribution of the mixture passing through the first several burners of a series of burners. Beyond a length of 7 ft. to 10 ft., the burners need to be broken into separately fed, shorter lengths (connected by cross-ignition end plate sets) to minimize burner distortion and stresses during alternate heating and cooling cycles. Also, the line type burners of present day technology have to be carefully matched to the equipment supplying air/gas premixture.

There are other disadvantages associated with present-day line burners. First, most line burners employ a premixture of the gas and air, and therefore, if for some reason the flame retrogresses into the mixture manifold, a fire or an explosion, referred to as flashback, could occur. The work by me leading to the development of the burner assembly of this invention has included the investigation of laminar and turbulent flame flashback in mixtures of methane and air and propane and air in high temperature environments (400° F. to 1700° F.). Many factors influence flashback in a nozzle or burner port. It has been shown that flashback can be controlled to a large extent simply by a cooling process. A method utilized by present line burners to reduce flashback is to use raised burner ports. If the surfaces of the raised ports are kept cool during the combustion process, the flame will not penetrate into the ports beyond a distance of a few millimeters corresponding to the heated zone of the port rim. Also, the ratio of the interior diameter to the exterior diameter of the raised ports influences flashback. The dead space (the space between the flame base and the burner surface), the mixture temperature, and the fuel and air mixture ratio also affect flashback in methane/air or propane/air (gas/air) mixtures.

While all of the above factors influence flashback, it is widely accepted, and has been demonstrated in studies I have conducted, that the critical boundary velocity gradient of the gas/air mixture is a primary controlling factor in flashback. When the gas/air mixture velocity exceeds the flame velocity as it exits the burner port or aperture, the flame has a lifting tendency. When the gas/air mixture velocity is less than the rate of flame propagation, then the flame has a tendency to retrogress down the port or aperture. In a premix-type burner, this retrogression could cause ignition within the burner body or the manifold. The burner assembly of the present invention provides a method of controlling the gas/air mixture velocity gradient, which controls lift-off of the flame and eliminates flashback through a wide range of percentages of stoichiometric combustion, gas/air mixture temperatures and turndown. Further, in most embodiments of this invention, the gas and air are not premixed in a combustible ratio at a mixture temperature above approximately 800° F.

In the case of line burners employing present technology, the input (BTUH) per linear foot might be decreased to the approximate energy requirement per foot of oven length, but there are other limitations in the use of conventional line burners when the total length exceeds 7 to 10 feet. As the mixture velocity increases through the body of the burner housing, the distribution of the gas/air mixture is affected, resulting in non-uniform burning. A further limitation of these line burners is that when long burner sections are interconnected, the burners have a tendency to arc or bow due to thermal expansion. These burners are further limited in that they are sensitive to the gas/air ratio.

The limitations of the present day line burners, and also of packaged-type burners, necessarily limits the performance of industrial ovens which utilize such burners. For example, I have developed the High Heat Transfer Oven of U.S. Pat. No. 4,235,023, the Radiant Wall Oven and Process of Drying Coated Objects of U.S. Pat. No. 4,546,553, and the Convection Stabilizied Radiant Oven (AIRRADIANT TM Oven) of U.S. Pat. No. 4,785,552. In the radiant-type ovens, conventional packaged-type burners have been employed, which release the energy of combustion in a rather confined space. Methods utilizing fans for distributing this energy are employed, which in one form or another distributes uniform heated air to the backside of the emitter walls. In the High Heat Transfer Oven, the mass movement of the air from the fans distributes the heat from the individual packaged burners well, but multiple burners and manifolds are required based upon the length of the High Heat Transfer Oven, which additional equipment increases the oven's cost.

While the designs described by these patents have proven to be highly efficient in maintaining uniform temperature on the surfaces of a vehicle or other objects passing through the respective oven, fans are required to distribute the heated air over the inner side of the emitter surfaces of the RADIANT WALL TM and AIRRADIANT TM ovens, and multiple burners are usually required in the High Heat Transfer Oven. A desirable and beneficial improvement in these ovens could result if the heat of combustion could be distributed over the inner emitter wall surface without the requirement of fans. Also, multiple burners could be eliminated in the High Heat Transfer Oven if the heat of combustion could be uniformly discharged throughout the oven length. The development of the burner assembly of the present invention provides a method by which heat can be transferred to the emitter walls in ovens described by U.S. Pat. No. 4,546,553 and U.S. Pat. No. 4,785,552, without the requirement of circulating fans in heater houses or within the internal cavity of the RADIANT WALL TM module. Also, the burner assembly of the present invention can uniformly distribute the heat of combustion throughout the full length of a High Heat Transfer Oven.

This burner assembly will have many other applications where it is desirable to release the energy of combustion over a long span, or where the temperature of the burner environment is highly elevated. While a present-day line burner has limitations as to the operational length, the burner of the present invention is capable of firing essentially any length of emitter wall or High Heat Transfer Oven. The limiting factor of length would not be because of distribution of the gas or air, or based upon thermal expansion and contraction problems, but based upon the time required for the flame to carry from the point of ignition to the other end of the burner. The burner assembly (burner) of the present invention overcomes these limitations and other problems that now exist with conventional line burners, and provides additional operational benefits, disclosed herein.

SUMMARY OF THE INVENTION

Briefly described, the first embodiment of the burner of the invention includes a channel-shaped, elongated, longitudinally extending, horizontally disposed, manifold housing which is closed at both ends and has an open top which is covered by a top plate. A smaller gas manifold duct extends longitudinally within and throughout substantially the length of the housing, and is supplied with gas under pressure from a gas source. The housing around the gas duct forms an air supply chamber with air under pressure from an air source. Both the gas and the air are selectively modulated by appropriate valves.

Supported on the top plate is an elongated U-shaped secondary air plenum. The air plenum supports a burner assembly having an elongated channel-shaped burner body, the upstanding opposed walls and ends of which form a U-shaped, inwardly opening perimeter which receives the perimetereal edges of a pair of juxtaposed, spaced, flat, rectangular, inner and outer horizontally disposed plates having spacers so as to define therebetween, a thin, wafer-like upper chamber. The plates are respectively provided with spaced holes or apertures, the apertures of one plate being offset laterally from the apertures of the other plate. A plurality of longitudinally spaced, upstanding venturi tubes extends from the gas duct upwardly through the air supply chamber, and abut the top plate, to be in alignment with spaced gas tubes within the secondary air chamber. The gas tubes extend through the secondary air chamber and are aligned at spaced locations with apertures in the bottom wall of the burner body. These venturi and gas tubes supply gas at spaced locations from the gas duct into the burner chamber of the burner body. Orifices in the sides of each of the venturi tubes permit primary air from the air supply chamber to admix with the gas as this gas travels upwardly and into the burner chamber. From this burner chamber, which extends longitudinally beneath substantially the entire length of the lower or inner plate, the mixture passes through apertures in the inner place and into the thin, wafer-like upper chamber. The mixture of gas and air then passes outwardly through the apertures of the outer plate, for burning as the mixture emerges.

Air from the opposed upstanding portions of the U-shaped secondary air plenum is directed through holes in the plenum, inwardly over the outer plate to admix with the combustible mixture emerging from the apertures of the outer plate. Thus, the gas/air mixture in the burner housing can be in an enriched ratio, so as not to be independently combustible in the housing, at mixture temperatures above the ignition temperature of the mixture. Further, because the gas and air are delivered independently to the burner assembly, a combustible mixture does not exist within the gas manifold.

The design of the burner assembly allows the gas/air mixture (at any ratio desired) to flow inwardly from the perimeter around each aperture or burner port in the upper plate. The burner assembly of this invention provides independent control of the velocity profile of the gas/air mixture entering the burner ports and leaving the burner ports in the burner plate. For any diameter of the burner port selected to control the discharge velocity of the gas/air mixture, a dimension for the space between the parallel plates can be selected to control the inlet velocity of the mixture to the burner port by increasing or decreasing the exit area for the gas/air mixture around its perimeter.

A total number of apertures or burner ports having a particular diameter can be selected for the outer or burner plate, which will ensure that the gas/air mixture exit velocity gradient from the aperture is less than the flame velocity or rate of flame propagation at maximum input. This ensures that the flame will not lift from the burner surface, or will lift only to a minute extent before the flame stabilizes. Therefore, a stable flame can be maintained through a wide range of turndown ratios of the burner. My tests have demonstrated that stable combustion can be maintained when the base of the flame is established at a height above the combustion surface which is equal to approximately ½ the diameter of the port (for small ports, less than 0.250"). Since the flow area around the perimeter of the apertures can be controlled by selectively adjusting the distance between the parallel plates, the velocity of the mixture around the perimeter of the apertures always can be greater than the flame velocity at minimum input, which prevents flame retrogression, and therefore, prevents flashback from occurring.

In the embodiment described above, secondary air for combustion is delivered inwardly from both sides of the upper plate through ports of the air plenum to mix with the gas/air mixture at the burner ports of the burner. This design requires little excess air for combustion, which adds to the burner's efficiency in an indirect fired heat transfer system. This primary embodiment easily can be modified, as shown in a second embodiment, to deliver gas, only, to the burner assembly, and to supply all the combustion air through the air plenum.

In a third embodiment, a gas housing supporting two, spaced plates each having apertures which are offset, as in the first embodiment, receives gas, only, from a manifold. The gas housing is received within an upper air plenum that also supports two, spaced, apertured plates, the upper plate forming the combustion or burner surface. The spaced plates of the air plenum are arranged above the spaced plates of the gas housing so that a mixing chamber is formed, therebetween. Gas flowing through the gas housing is evenly distributed over the surface of the plates of the gas housing, and into the mixing chamber where it is mixed with the air delivered from the air plenum. The upper and lower plates of the air plenum perform the identical functions as those in burner housing of the primary embodiment, that is, they assist in controlling the gas/air mixture inlet velocity to the burner ports independently of the outlet velocity.

In a fourth embodiment, gas is delivered through an inlet gas manifold to a burner housing essentially identical in structure and function to the housing of the first embodiment. The principal difference in this embodiment is that the combustion air is entrained with the gas through a venturi. This embodiment also functions to preclude flame retrogression through the burner apertures by utilizing spaced, parallel plates. Since this design eliminates the air manifold, the environment in which the burner is operated must contain oxygen for combustion.

A fifth embodiment utilizes a gas/air manifold for premixing a combustible ratio of gas and air. The premixed gas and air are then delivered to a burner housing essentially identical to that of the primary embodiment.

In each of the above-described embodiments and their modifications, parallel burner plates are utilized to control the mixture velocity gradients entering and exiting the burner apertures.

Accordingly, it is an object of the present invention to provide a gas burner assembly that can uniformly discharge its energy of combustion along a linear path.

Another object of the present invention is to provide a gas burner assembly, linear in its construction, that can operate in an oxygen free atmosphere at elevated temperatures.

Another object of the present invention is to provide a gas burner assembly on which the manufacturing tolerances can be closely maintained, while at the same time is inexpensive to manufacture, durable in structure and efficient in operation.

Another object of the present invention is to provide an apparatus and process for burning fuel capable of substantially achieving complete combustion with minimum excess air.

Another object of the present invention is to provide an apparatus and process that will operate without back flashing (flashback) even when the burner is operated in an environment of high temperatures.

Another object of the present invention is to provide a linear burner which, as a unit, can extend over a substantial distance within an oven.

Another object of the present invention is to provide a burner assembly which is capable of withstanding substantial temperature changes without appreciable stresses on the parts of the burner assembly.

Another object of the present invention is to provide a burner assembly in which the burner elements can readily expand and contract as the burner elements are heated and cooled.

Another object of the present invention is to provide a gas burner assembly that can maintain a uniform turndown over a long span.

Another object of the present invention is to provide a gas burner assembly that is easily installed and removed.

Another object of the present invention is to provide a gas burner assembly that can be operated at any angle around its longitudinal axis while maintaining stable combustion without backflashing.

Another object of the present invention is to provide a gas burner assembly that operates efficiently through a wide range of premixing of the gas and air before combustion, and nozzle mixing at the point of combustion, the range being from 100% premixture without any nozzle mixing to 100% nozzle mixing without any premixing.

Another object of the present invention is to provide a gas burner assembly that is capable of incinerating volatile organic compounds contained in the exhaust gases from conventional curing processes.

Another object of the present invention is to provide a gas burner assembly on which turndown can be accomplished by modulating either the gas pressure only, or a combination of the gas pressure and air pressure.

Another object of the present invention is to provide a gas burner assembly in which the gas and air are independently supplied to eliminate exposing a combustible mixture to the elevated temperatures in an oven or other high temperature environment.

Another object of the present invention is to provide a gas burner assembly which will partially mix gas and air by entrainment of the air in individual streams of gas and then by admixing the partially mixed stream.

Another object of the present invention is to provide a gas burner assembly on which the rated input to the burner can be easily changed by altering the gas orifice diameter and correspondingly altering the air supply.

Another object of the present invention is to provide a gas burner assembly that does not require the use of high pressure combustion air blowers, but can operate efficiently using conventional centrifugal blowers at relatively low air pressures.

Another object of the present invention is to provide a gas burner assembly that operates with minimum noise associated with its air supply or its combustion.

Another object of the present invention is to provide a gas burner assembly that can operate efficiently by using a venturi to aspirate the primary air for combustion, therefore, eliminating the requirement of a combustion air blower or an air manifold.

Other objects, features and advantages of the present invention will become apparent from the following description when taken in conjunction with the accompanying drawings, wherein like characters of reference designate corresponding parts throughout the several views.

DESCRIPTION OF THE PREFERRED EMBODIMENTS

Figure 1:
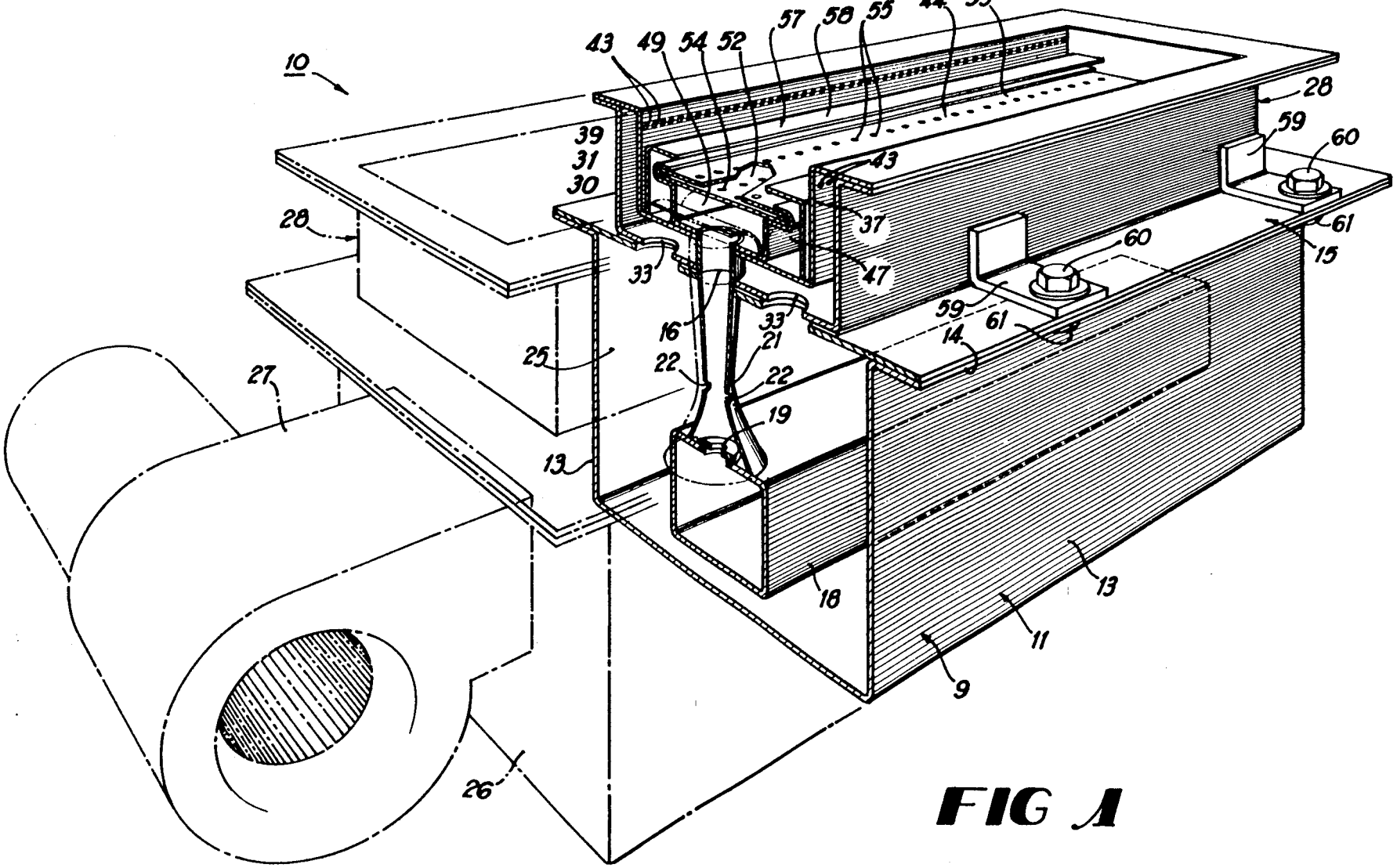
FIG. 1 is a perspective view of the preferred embodiment of the present invention.
Figure 2:
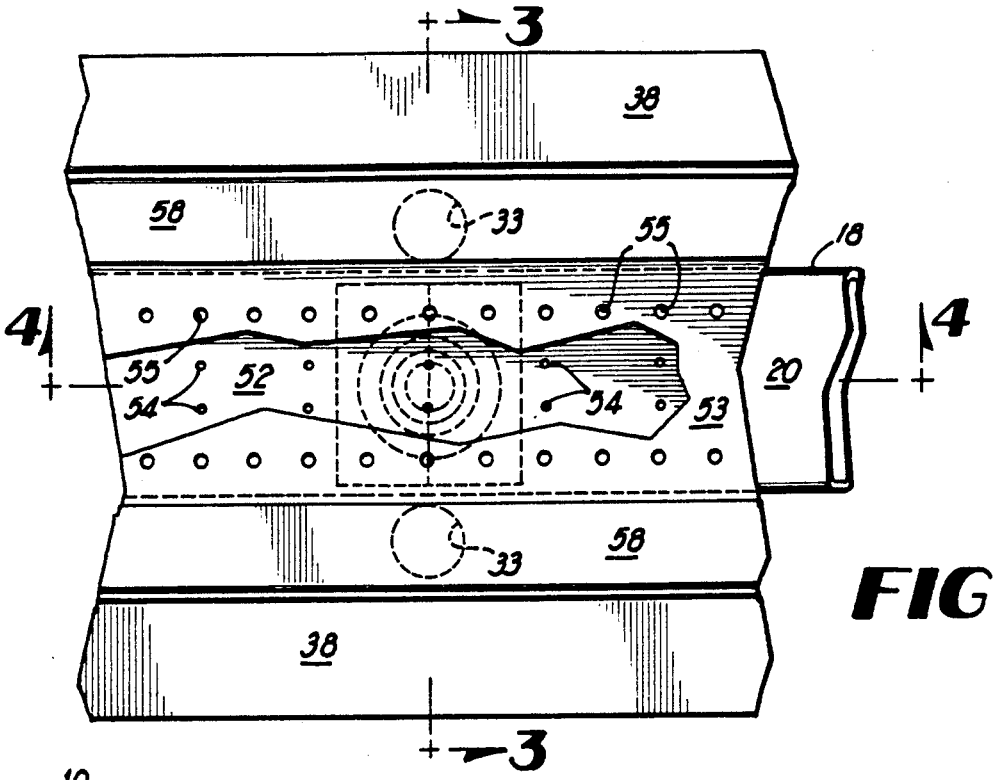
FIG. 2 is a fragmentary plan view of the embodiment of FIG. 1.

Referring now in detail to the embodiments chosen for the purpose of illustrating the present invention, numeral 10 of FIG. 1 depicts generally a burner assembly having mixture manifold assembly 11 which includes an elongated, longitudinal extending, horizontally disposed channel-shaped manifold housing 9 which has a bottom wall 12, and a pair of opposed upstanding side walls 13. The ends of the manifold housing 9 are closed by end walls, such as wall 26. The upper edges of the side walls 13 and end walls, such as end wall 26 are provided with upwardly protruding flanges, such as flange 14, which form a perimeter in a horizontal plane, parallel to and above the bottom wall 12. A top plate 15 is provided with two, parallel outer rows of longitudinally spaced apertures 17 and a central row of longitudinally spaced apertures 16. Below the central row of apertures 16 and within the confines of the manifold housing 9 is a gas duct or gas manifold 18 which extends longitudinally, substantially throughout the length of manifold housing 9. The upper wall 20 of the gas manifold 18 is provided with a plurality of spaced orifices 19 which are respectively aligned vertically with the gas apertures 16. Each gas orifice 19 is provided with a gas restricting means such as a gas restricting means 7 which is externally threaded, defines orifice 8 therethrough and is provided with a hexagonal head so that it can be threadedly received in the gas orifice 19. By changing the size of the gas restricting means 7, the amount of gas passing through the restricting means 7 can be changed, as desired.

A centrifugal blower 27 is mounted on the end wall 26 of the manifold housing 9 so as to discharge air into the air chamber 24 of the manifold housing 9, to provide a source of air through the burner assembly 10. This blower 27 can be mounted externally of housing 9 for feeding air from an external source to appropriate ducts through the manifold housing, if desired.

Mounted over each of the restricting means 7 and extending upwardly from the upper wall 20 of the gas manifold 18, are a plurality of venturi tubes or mixing tubes 21, these mixing tubes 21 respectively communicating at their upper ends with the gas apertures 16 in the plate 15. In an intermediate portion of each of the venturi tubes 21 are orifices or openings 22. The venturi 21 also serve the function of supporting the gas duct or gas manifold 18.

Figure 3:
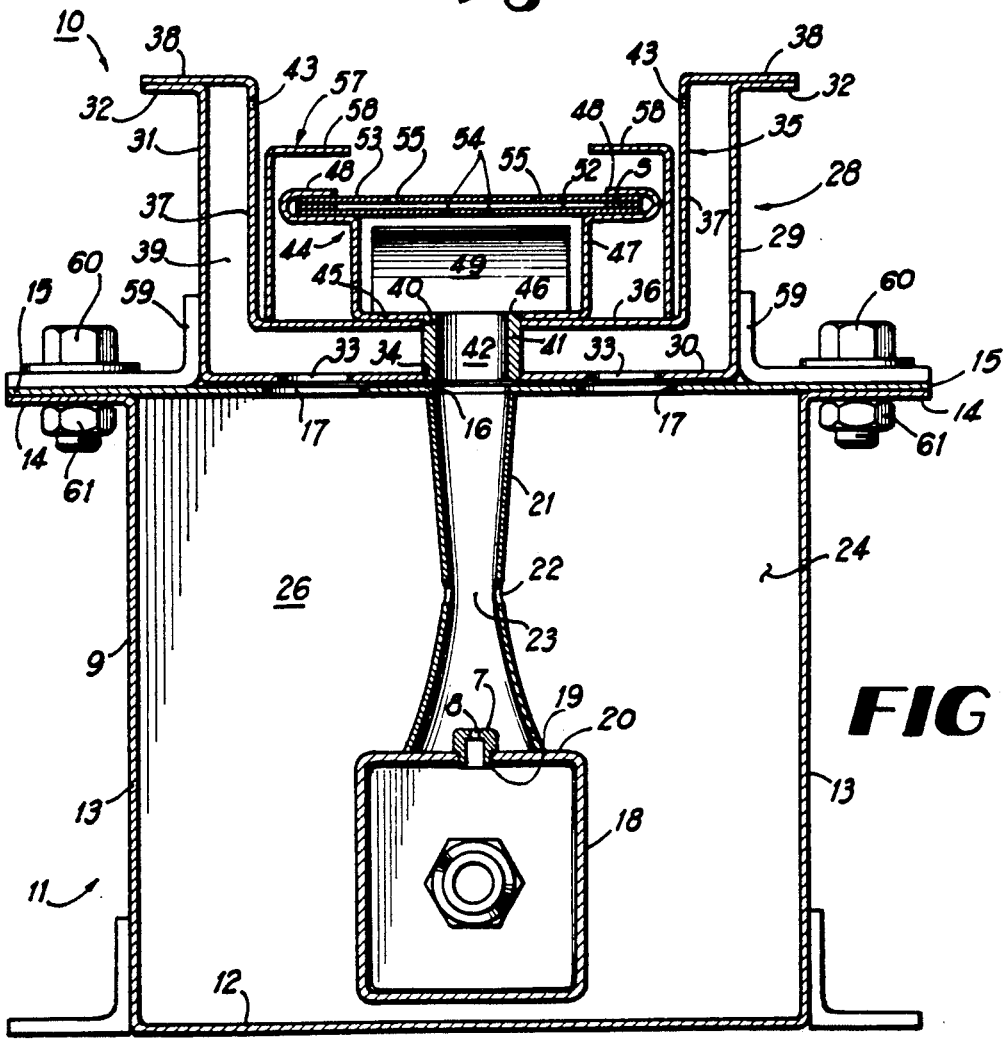
FIG. 3 is a transverse cross-section taken along lines 3—3 of FIG. 2.

Gas manifold 18, venturi 21 and plate 15 are arranged as depicted in FIG. 3, and are preferably welded together, but can be joined by any common means well known in the art to allow for the flow of gas from manifold 18 through orifices 19 and 16. Although tube 21 can be in the shape of a venturi with air orifices 22 at the throat 23, tube 21 can also be cylindrical, having opposed apertures, and still achieve its desired function, as is detailed later. The communication of these elements, therefore, results in air supply chamber 24 which contains air under pressure and which is separated from the gas contained in gas manifold 18 and mixing tubes 21. When gas is directed through the restricting means 7, it entrains and mixes with the air passing into tubes 21 via orifices 22.

The gas line fittings (not shown), including gas intake fittings and end cap of gas manifold 18, and the mounting elements of centrifugal fan 27 to wall 26 are well know in the art and not further described herein.

Supported by plate 15 is air manifold or plenum 28 having upstanding, U-shaped or channel-shaped outer housing 29 which includes bottom wall 30 and side walls 31 that terminate in laterally extending flanges 32. Bottom wall 30 defines air apertures 33 which are aligned with and are smaller in diameter than air apertures 17 of plate 15. The smaller apertures 33 in the wall 30 register with air apertures 17 in the top plate 15 so that the small apertures 33 define the size for the proper air flow to plenum 28. The diameter of apertures 33 can be decreased, thereby decreasing air flow through apertures 33, by inserting a thin washer or apertured plate (not shown) between top plate 15 and bottom wall 30. Wall 30 also defines a centrally disposed longitudinal row of spaced orifices 34 which communicate respectively with apertures 16. Air manifold 28 also includes upstanding, U-shaped or channel-shaped inner housing 35 with bottom wall 36 and opposed upstanding side walls 37 that terminate in laterally extending flanges 38. Flanges 32 support flanges 38 so that the opposed inner walls 37 are spaced inwardly from outer walls 29, and wall 36 is spaced from wall 30, as shown in FIG. 3, to form air plenum or chamber 39, closed at both ends.

Flanges 32 and 38 can be welded or riveted for permanent mounting, or can be secured by bolts or other releasable means, as desired. Wall 36 defines a plurality of spaced central apertures 40 which are respectively aligned with orifices 34. Tubes 41 respectively surround orifices 34 are welded to walls 30 and 36 to connect apertures 34 and 40, and thus, define passageways 42, therebetween. Along the upper portion of inner walls 37 on each side of air manifold 28 are spaced, combustion air ports or secondary air discharge ports 43. Spaced secondary air discharge ports 43 are provided in opposed relationship along the entire length of inner walls 37.

Figure 4:
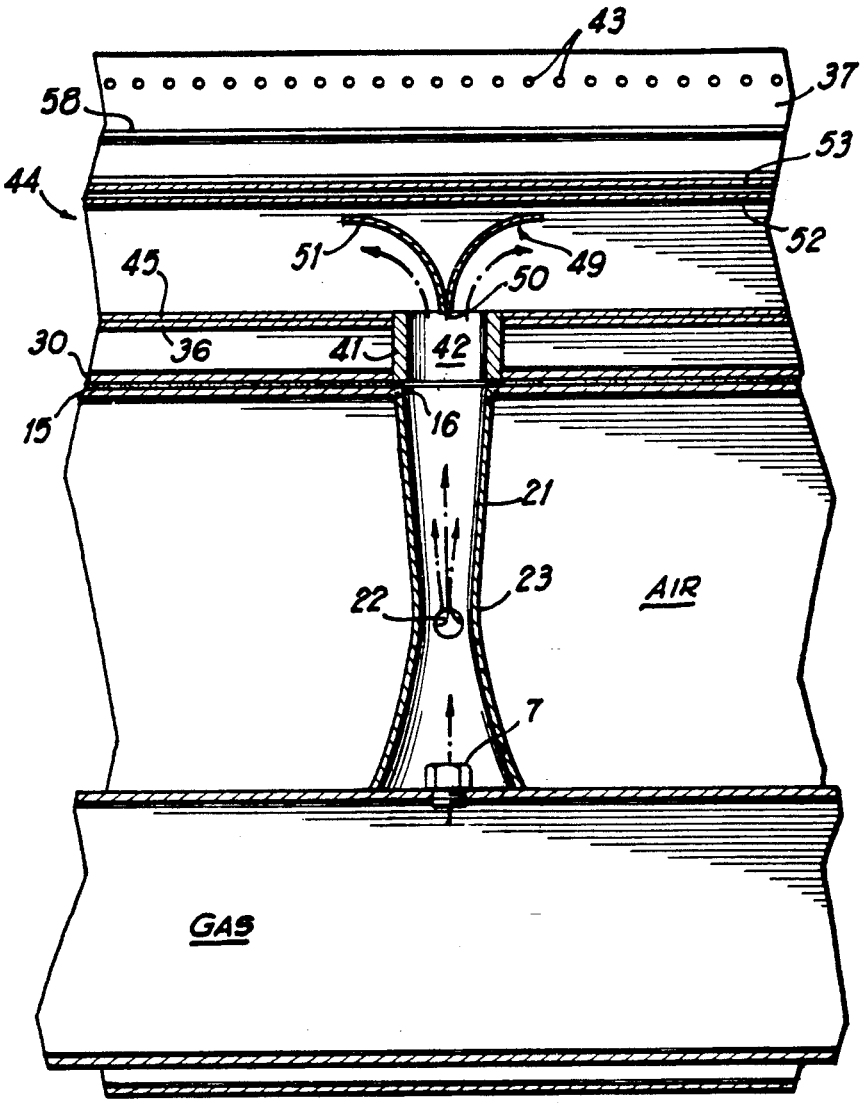
FIG. 4 is a longitudinal cross-section taken along lines 4—4 of FIG. 2.

Supported on bottom wall 36 of housing 35 is burner housing 44. Burner housing 44 comprises bottom wall 45 that defines longitudinally spaced central orifices 46, which are respectively in alignment with apertures 40. Tubes 41 extend to wall 45 and also are welded at their upper ends to wall 45 around the periphery of orifices 46. Housing 44 also includes opposed upstanding side walls 47 and end walls (not shown) which terminate at their upper ends in inwardly opening, U-shaped retaining perimeteral frame 48. Baffles 49 are attached to the upper side of wall 45 and are mounted so that an apex 50 of a baffle 49 extends across each of the orifices 46 and curved arms 51 extend in the longitudinal direction of housing 44, as shown in FIG. 4.

Received in retaining frames 48 are two juxtaposed, rectangular, spaced, flat, metal, parallel plates, lower plate 52 and upper plate or burner plate 53. Plates 52 and 53 are held in spaced relationship by spacers S, which are preferably located along each side of plates 52 and 53. Plates 52 and 53 therefore, are held in parallel, spaced relationship along their entire lengths. The perimeteral frames 48 retain the two plates 52 and 53 closing the open upper end of housing 44. When the plates 52 and 53 are heated, they expand into the frames 48 and when they cool, they retract partially from the frames 48.

Figure 5:
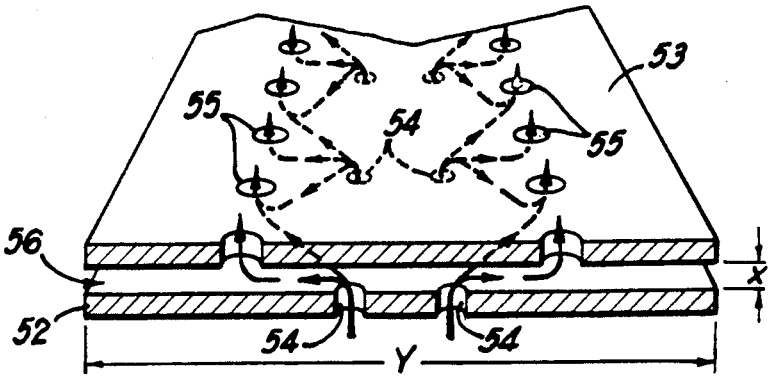
FIG. 5 is a diagrammatic, fragmentary perspective of a portion of the burner plates of FIG. 3.

As best shown in FIG. 5, plate 52 is provided with a pair of longitudinally extending rows of equally spaced apertures 54, therethrough. Plate 53 defines two rows of apertures or burner ports 55. Similarly, apertures 54 and 55 are staggered, or offset in relation to one another so that gas or the gas/air mixture entering apertures 54 must travel laterally in the chamber 56 between plates 52 and 53 before entering apertures 55. The plates 52 and 53 are opposed, juxtaposed, flat, parallel, elongated, rectangular, metal members which are preferably made from between about 20 gauge and about 11 gauge stainless steel sheets with a longitudinal distance between centers of the burner ports 55 being about ½ inch, and the longitudinal distance between centers of the apertures 54 of about 1 inch so that the inner plate 52 has about one half of the number of apertures 54 as there are ports 55 in plate 53.

The space or wafer-thin chamber 56 between plates 52 and 53 has horizontal dimension Y and vertical dimension X. While dimension Y is fixed or constant and cannot be adjusted for a particular burner, dimension X can be varied by utilizing different sized spacers S.

Mounted between housing 44 and wall 37 are elongate, upwardly extending air baffles 57, which terminates in lateral deflectors 58, that extend inwardly.

In FIG. 3, secondary air manifold 28 and the mixture manifold assembly 11 are shown secured together by mounting brackets 59, bolts 60 and nuts 61. It is obvious, however, that manifold assembly 11 and manifold 28 can be joined by any desired means such as clamps or other releasable means. A gasket (not shown) can be placed between plate 15 and wall 30. Because of the low air pressure at orifices 17, usually less than 1.5 inches water column, and the low pressure of the gas/air mixture in tube 41, however, it is not absolutely necessary to incorporate such a gasket, as long as plate 15 and wall 30 fit together correctly.

The input gas pressure in duct 18 can be selectively modulated using any conventional gas valve means (not shown) well known in the art. Similarly, the air pressure in chamber 24 can be selectively modulated by controlling centrifugal blower 27, as is also well known in the art.

In operation, gas is delivered through gas manifold 18, venturi or mixing tubes 21 and into the burner chamber of burner housing 44. Simultaneously, blower 27 delivers air through air supply chamber 24 of manifold assembly 11. The air travels through apertures 17 and 33, and into secondary air chamber 39 of air plenum 28. For a fixed air pressure in the manifold assembly 11, the volume of combustion air supplied to ports 43 can be controlled by the diameter of the orifices 33. To ensure distribution throughout the length of the air plenum 28, a pressure drop should be taken across orifices 33. The secondary air from plenum 28 passes through secondary air ports 43, and ultimately mixes with the gas/air mixture near the burner ports 55, for combustion. Baffles 57, which can be removed if desired, direct the air in a horizontal direction across the plate or burner surface 53, and prevents the direct impingement of air on surface 53, which could affect flame stability at low fire.

While the mixture manifold assembly 11 independently delivers the gas and air for combustion, a controlled amount of premixing of gas and a portion of the combustion air which enters the burner housing 44 is accomplished in each venturi or mixing tube 21 leading from the gas manifold 18 to the burner housing 44. The amount of premixing of air with the gas is controlled by the size of the orifices 22 through the wall of mixing tube 21. The mixing tube 21 can be a venturi with the air passages located at the throat 23. Since orifices 22 of mixing tube 21 are exposed to the air pressure within mixture manifold assembly 11, an air flow will occur due to the pressure differential in manifold assembly 11 and mixing tube 21. However, with the air pressure in the manifold assembly 11 remaining constant, the amount of air entrained increases as the velocity of the gas in mixing tube 21 increases. As the gas pressure is increased, a proportional amount of air is entrained in mixing tube 21 and ultimately into the burner housing 44. While a venturi-shaped tube probably entrains air more efficiently, the burner assembly 10 works well with the wall of the mixing tube 21 being cylindrical. Since the air supply to mixing tube 21 is under positive pressure, the venturi shape is not as important as would be the case if the air were being entrained from a space with no positive air pressure. The quantity of air entering each mixing tube 21 is dependent on the air pressure in the manifold assembly 11, the total area of the orifices 22, and the effect of the entrainment action of the gas discharged from its orifice at increased velocities with gas pressure.

There is an advantage to having a fixed pressure of the air entering orifice 22. As the gas pressure is decreased, for a fixed diameter of orifice 22 the ratio of air to gas increases as the burner is modulated down, in the preferred embodiment. This occurs because there is a constant flow of air independently of the entrainment action of mixing tube 21. Therefore, while the gas input is being decreased, the air supplied to mixing tube 21 does not decrease in the same proportion, and the air to gas ratio increases, improving the flame stability at low fire.

The gas/air mixture then enters burner housing 44 through tube 41. Baffles 49 uniformly distribute the gas/air mixture flow longitudinally within housing 44. The mixture then enters apertures 54 of lower plate 52, and travels laterally in the thin chamber 56 between plates 52 and 53 and into apertures 55 of burner plate 53. Burner plate 53 constitutes the combustion or burner surface. The arrangement of plates 52 and 53 and offset apertures 54 and 55 operate to prevent any retrogression of the flame through apertures 55 and into the chamber 56 between plates 52 and 53. Flame retrogression, and subsequent backflash, is prevented by controlling the velocity of the gas/air mixture entering ports 55. Flame liftoff from plate 53, however, can be prevented by controlling the mixture velocity exiting ports 55.

The gas/air mixture enters ports 55 at a velocity based upon the perimeter of port 55 and the thickness of spacers S. The flow area of each port is equal to ($\pi$) x (port 55 diameter) x (dimension X). The thickness of spacers S (dimension X) should always be less than port 55 diameter divided by (4).

The total flow area of the gas/air mixture, determined by the total perimeter of all ports 55 times the separation distance (dimension X) of the plates 52 and 53, produces a velocity at the perimeter entrance of ports 55 which exceeds the rate of flame propagation at the lowest operating input of burner assembly 10. While other factors previously discussed may affect the quenching of the flame, if the profile of the velocity gradient at this point is at all times maintained greater than the rate of flame propagation, retrogression of the flame is prevented. When these conditions are met, the burner assembly 10 is incapable of back flashing due to flame retrogression.

To assure flame stability, or a flame front which is established and burns for a fixed firing rate without pulsating or quenching, the total cross-sectional area of all the ports 55 can be such that the discharge velocity at high fire can be equal, or nearly equal, to the flame propagation. It is not essential to achieve burner stability, however, for the mixture velocity at the discharge of ports 55 to be absolutely less than the flame propagation. Because of an immediate divergence of the gas/air mixture from the apertures 55, stable combustion can occur with the base of the flame established within a minute distance above apertures 55. While this dead space can also be a contributing factor in the prevention of flashback, this burner does not depend upon dead space to preclude flashback. The flow area of all of the ports 55 can be an amount that would create an exit velocity less than the rate of flame propagation, and flashback would still be precluded, because of the higher velocity of the gas/air mixture around the perimeter at the entrance of ports 55. While the gas/air mixture velocity from the discharge of ports 55 does not have to be greater than the rate of flame propagation, because of the flame quenching ability of the burner design, in practical applications the velocity from ports 55, except at low firing rates, is usually higher than the rate of flame propagation.

At a distance of ½ the diameter of port 55 from port surface 53, the diameter of the flow pattern of the mixture would be 2 times port 55 diameter, if the divergence angle were 45°, which is reasonable from a thin orifice. This would obviously produce a cross-sectional area of the flow pattern of the mixture of 4 times the actual port 55 area. As an example, if port 55 diameter of 0.125 inches is selected, the area of port 55 would be 0.01227 inches square. But just 1/16 inch above port 55, the area of flow would be 0.04909 inch square, or 4 times greater than the area of port 55. It is desirable for a space of at least 1/16 of an inch to exist between the base of the flame and port surface 53 at the maximum firing rate of the burner. Tests have demonstrated that when port 55 diameter of 1/2 the calculated diameter for flame contact with port 55 is used, complete and stable combustion is achieved.

When computing the mixture velocities, the expansion of the mixture due to an increase in temperature has to be considered. This increase in temperature of the mixture will vary with the environment temperature in which burner assembly 10 is operated, and is easily determined by tests or could be approximated by calculations involving heat transfer theory. Also, the coefficient of discharge of the orifices must be considered in computing the orifice diameters. To satisfy pure academic interest, every theoretical fluid flow variable might be considered, but as a practical matter, the design of gas burners is not an exact science. If, in the design, flashback of the flame is absolutelY precluded and burner assembly 10 can operate without excessive air to achieve complete combustion, the exact position of the base of the flame with reference to burner surface 53 is not critical in the burner assembly 10 of this invention. Therefore, there is latitude in determining the diameter of ports 55. In other words, the performance of burner assembly 10 is not affected by any observed amount if the flame base contacts burner surface 53, or is established above the surface 53, so long as the flame is stable and does not lift off to the extent that it is extinguished.

To attest to the flexibility of burner assembly 10, a test burner using forty-eight (48) ports in plate 53 per foot of burner assembly 10 length, with a diameter of 0.1250 inches, and twenty-four (24) ports 54 in plate 52 per foot of burner with a diameter of 0.1250 inches, and with a separation between the plates (dimension X) of 0.020 inch performs well within a range of maximum inputs of 20,000 BTU/hr./ft. to 40,000 BTU/hr./ft., with a maximum manifold 28 air pressure of 1 inch of water column. Calculations and tests have shown the (dimension X) could be increased to 0.050 inch, and flashback of the burner would still be absolutely precluded.

In another test burner, the number of ports 54 contained in plate 52 was left at twenty-four (24) with a diameter of 0.1250 inch, and the number of ports 55 contained in plate 53 were left at forty-eight (48) but the diameter of ports 55 were increased to 0.250 inch, and still good test results were obtained. In summary, when burner assembly 10 is used to heat ovens of my prior inventions, the following is a range of dimensions of flow areas of the air and the air/gas mixture, along with a range of air and gas pressures, which result in stable flame without flame retrogression.

| | |
|---|---|
| MIXING TUBE 21 DIAMETER | .5 to 1.25 inch (2 ft. of burner) |
| VENTURI TYPE MIXING TUBE 21 | Entrance 1.25 inch (2 ft. of burner)<br>Throat .625 inch<br>Discharge 1.25 inch |
| ORIFICES 22 OF MIXING TUBE | .00 to .098 inch. (2 ft. of burner) |
| AIR ORIFICES 33 | .4375 to .6875 inch (2 ft. of burner) |
| NUMBER OF ORIFICES 54 (PLATE 52) | 12 to 14 with diameter = .125 inch (ft./burner) |
| NUMBER OF ORIFICES 55 (PLATE 53) | 24 with diameter = .125 to .250 inch (ft./burner) |
| SPACE BETWEEN PLATES (× DIMENSION) | .020 to .050 inch |
| GAS PRESSURE | .2 to 20 inch water column |
| AIR PRESSURE | .4 to 1.5 inch water column |
| TURNDOWN RATIO | 6–1 |

-continued

| | |
|---|---|
| RANGE OF MAXIMUM INPUTS | 20,000 BTU/hr./ft. to 50,000 BTU/hr./ft. |

The pressure drop across the outer and inner plate depends on the velocity through the plates and therefore is dependent on orifice size and burner BTUH input. However, the range of this pressure drop would be about 0.002 inches water column to about 0.18 inches water column for the drop across burner ports 55 of the outer plate 53 and the range would be about 0.002 inches water column to about 0.36 inches water column for the apertures 54 of inner plate 52.

The above dimensions of burner assembly 10 orifices and pressures does not represent a limitation, but indicate a range of dimensions that have been demonstrated by tests to work well in the application for providing the heat source for ovens or my prior inventions. The pressure drop across inner plate 52 should not exceed 0.4 inch of water and the drop across outer plate 53 should not exceed 0.2 inch of water, while the total pressure drop across both plates 52 and 53 should not exceed 0.6 inch of water. The thickness of plates 52 or 53 should be from about 0.010 inch to about 0.060 inch. The range diameters of apertures 54 and 55 can be from about 1/16 inch to about ¼ inch.

The range of inputs tested are more than adequate for most oven requirements. As an example, if the total heat load of an oven 100' in length were 3,000,000 BTU/hr., burner assembly 10 with, for example, a maximum input of 30,000 BTU/hr./ft. could be used. If burner assembly 10 were used on each side of the oven, the maximum input would be 6,000,000 BTU/hr. for heat up, and then burner assembly 10 would modulate down to its mid-range of 15,000 BTU/hr./ft., with a turndown ratio of 6 to 1. The burner assembly 10 could further modulate to a total input to the oven of 1,000,000 BTU/hr. to accommodate conveyor stoppage or a slowing of the process.

The burner assembly 10 is capable of maintaining complete combustion with a minimum of excess air (less than 12%). As discussed, an important feature of this invention is that control of the input can be accomplished through manipulation of a gas valve (not shown) to modulate the gas pressure, only. The air pressure for combustion need not be changed or reduced during turndown. This feature simplifies the control design and at the same time allows a constant pressure in the air manifold 28 that will ensure good distribution throughout the burner length. As the input to the burner 10 is turned down, since the discharge of air from ports 43 is constant, excess air is supplied to the burner 10 during turndown. If, in certain applications, excess air would detract from the operating efficiency of burner assembly 10, the air supply can also be modulated to maintain a constant fuel/air ratio, which ensures minimum excess air at all operating inputs.

During normal operation of burner assembly 10 at or near its highest rated input, the base of the flame is established above burner plate 53 and under the flange 58 of baffle 57. The flame emerges around baffle 57, and the remaining air required for combustion is supplied through ports 43. The mixing effect created by the geometry of the burner allows complete combustion to occur with a fairly short flame length.

The input per foot of burner assembly 10 is determined by its application. For example, if it is determined that 98 feet of burner assembly 10 will be used on each side of an oven, to produce a total heat input to the oven of 5,880,000 BTU/hr. (or 30,000 BTU/hr./ft. of burner length after the heat transfer efficiency is taken into account), the burner assembly 10 maximum input is established. The burner assembly 10 will be designed for a BTU/hr./ft. turndown ratio of 6 to 1. Tests have demonstrated that the burner assembly 10 can achieve stable and complete combustion at this turndown ratio.

The amount of air entrained for premixing in mixing tube 21 contained within the manifold 11 has been determined from experimentation. At best it is difficult to theoretically design a venturi or mixing tube 21 when the air pressure at the entrance to the venturi or mixing tube 21 is the same as the air pressure at the burner surface 53. However, when the air is at a higher pressure (even as low as 1 inch of water column), it would be almost impossible to predict theoretically the total air entrained. The area of the air ports 22 contained in mixing tube 21 have been varied in test work from a total area of 0.00614 inches square to 0.098 inches square. Actually, in the second embodiment of the burner assembly 10, no air is introduced into mixing tube 21. But when it has been determined to use some premixture, the smallest orifices 22 into tube 21 for which tests have been conducted have been two 1/16 inch diameter apertures. In the range of burner input at high fire of 20,000 BTU/hr./ft. to 40,000 BTU/hr./ft., good results have been achieved with a total area of around 0.050 inches square for ports 22.

In the tests conducted on burner assembly 10 using an aperture 22 area of approximately 0.05 inches square in the throat 23 of mixing tube 21, with manifold assembly 11 air pressure between 0.5 inches and 1.5 inches water column to introduce air for premixing with the gas, the burner assembly 10 operates in a stable condition with complete combustion. Approximately 30% to 60% of the air for premixing is supplied under these conditions, and a greater ratio of the air for combustion is supplied as the input to the burner assembly 10 is reduced, as previously explained.

In order to determine the air pressure required to supply the premixture air through orifice 22 and to determine the pressure drop through the burner orifices 55, the equation relating to pressure difference and velocity of gas through an orifice or aperture is utilized, as follows:

$$V = \sqrt{\frac{2g\Delta P}{\rho}} \qquad 1.$$

where:

V = Velocity (ft/sec)

g = Acceleration of gravity (32 ft./sec$^2$)

$\Delta P$ = Pressure difference (lbs/ft.$^2$)

$\rho$ = Density of the fluid (lbs/ft.$^3$)

For the purpose of burner assembly design, it is more useful to express the units of pressure in inches of water column. The equation can then be written as follows:

$$V = \sqrt{\frac{2g\Delta P 5.197}{\rho}} \quad 2.$$

Combining constants:

$$V = 18.294\sqrt{\frac{\Delta P}{\rho}} \quad 3.$$

Where Δ P is expressed in inches of water column and all other units remain as in Equation 1. Replacing Density in the equation to allow for properties of mixture of gases (such as methane and air) with the universal gas equation for atmospheric pressure, the equation is rewritten as follows:

$$V = 18.294\sqrt{\frac{\Delta P\, RT}{P\, Vo}} \quad 4.$$

For atmospheric pressure, since all calculations are based on incompressible flow, and 1 ft.$^3$ of air or mixture since density of Equation 1 was in lb./ft.$^3$:

$$V = 18.294\sqrt{\frac{\Delta P\, RT}{(14.7)(144)(1)}} \quad 5.$$

Combining constants:

$$\text{where: } V = .3977\sqrt{\Delta P\, RT} \quad 6.$$

V=Velocity (ft./sec)
P=Pressure difference (inches $H_2O$)
R=Gas constant
T=Temperature (°R)

The gas constant R for any gas is the quotient obtained by dividing the universal gas constant by the molecular weight of the gas:

$$R = \frac{1545}{m} \quad 7.$$

$R$ = Gas constant
$m$ = Molecular weight of the gas

In a mixture of gas, such as methane and air, the proportions are known or can be measured. The weighted average molecular weight (the apparent molecular weight) may be calculated, and a value of R obtained from R is equal to 1545/m to apply to the mixture. The molecular weight of methane is 16.043, and of propane is 44.097 and of air is 28.97. The gas constant R can be calculated for any mixture of air and methane, and of air and propane.

In order to determine the pressure drop across an orifice, Equation 6 can be rewritten in the following form.

$$\Delta P = \left(\frac{V}{.3977\sqrt{RT}}\right)^2 \quad 8.$$

$$\text{or} \quad \left(\frac{V}{.3977}\right)^2\left(\frac{1}{RT}\right)$$

Where:
P=Pressure drop across an orifice or a series of orifices (inches of water)
V=Velocity through the orifice or series of orifices
R=Gas constant
T=Temperature (°R)

The above equations in combination with the simple equation of flow will enable most of the burner calculations to be performed.

$V_o$=(V) (A)
$V_o$=Vol. (ft$^3$/hr.)
V=Vel. (ft./hr.)
A=Area ft$^2$

The following calculations are exemplary of the design of a typical burner assembly 10:

Given
input to the burner assembly 10 on high fire is to be 30,000 BTUH/ft;
orifice 22 in the mixing tube 21 is to be 0.05 inches square, based on test;
combustion air temperature is 150° F.:
amount of pre-mix is 30% of theoretical air (stoichiometric air), based on test
dead space above burner port 55 is to be ½ the port 55 diameter;
mixture divergence angle is 45°; and
combustion blower, 1 inch static pressure is to be used.

At high fire the ratio air/gas mixture will not exceed that at low fire, because of the constant pressure in the manifold assembly 11. Therefore, assuming the worst case condition that the ratio will remain constant, the total mixture volume will be:

| | |
|---|---|
| Gas = | 30 ft.$^3$/hr. |
| Air-30% premix = | 90 ft.$^3$/hr. |
| Total mixture = | 120 ft$^3$/hr. |

The air required for combustion, the flame velocity of methane and the heating value of natural gas would either be known by one skilled in the art, or a reference on combustion could be consulted. Orifice 22 diameter in mixing tube 21 when air in chamber 39 is at 1 inch static $H_2O$:

$$\text{Vel} = .3977\sqrt{\Delta P\, RT}$$
$$= .3977\sqrt{(1)(53.3)(610)}$$
$$= 71.7 \text{ ft/sec}$$

$$\text{Vol} = (\text{Vel})(\text{Area})$$
$$= (71.7 \text{ ft./sec})(.000349 \text{ ft}^2)(3600 \text{ sec/hr.})$$
$$= 90 \text{ ft}^3/\text{hr}$$

A reasonable $C_D$ (coefficient of discharge) for flange entry is .5.
Therefore:
(.5)(90 ft.$^3$/hr.)
= 45 ft$^3$/hr. (for two ft. burner)
= 22.5 ft$^3$/hr. (for one ft. burner)
Correcting for density:

$$= 22.5\left(\frac{520}{610}\right)$$
$$= 19.1 \text{ ft.}^3/\text{hr./ft. of burner assembly}$$

Since the input at low fire will be 5,000 BTUH, requiring 15 ft.$^3$ air/ft. for 30% premix, 19.1 ft.$^3$ of air would increase the air ratio to 38%, which is on the safe side to preclude flashback if the calculations are made for 30% premix.

At a flame velocity of 1.5 ft./sec, the velocity of the mixture at ½ the diameter of port 55 above the burner surface 53 should be less than 1.5 ft./sec. at high fire. Therefore:

$$\text{Area} = \frac{\text{Vol}}{\text{Vel}} = \left(\frac{120\ \text{ft.}^3/\text{hr.}}{5400\ \text{ft./hr.}}\right)\left(\frac{710}{520}\right) = .03034\ \text{ft.}^2 \text{ or } = 4.36\ \text{in}^2$$

Using orifice 55 spacing of two rows on ½ inch centers for a total of 48 orifices:

$$\frac{4.36}{48} = .0908\ \text{in}^2$$ (area above each orifice at ½ the port diameter above the burner surface)

Therefore:

$$\text{Area of orifice 55 in plate 53} = \frac{.0908}{4} = .02270\ \text{in}^2$$

Use $C_D$ of .85 to obtain actual flow area $$A = \frac{.02270}{.85} = .0267\ \text{in}^2$$

From a table of areas of circles select a diameter 3/16 inch which has an area of 0.02761 in² and a circumference of 0.58905 inch.

To determine the space between plates 52 and 53 to preclude flashback:

$$\text{Flow Area} = \frac{\text{Vol. (at low fire)}}{\text{Flame velocity (ft./hr.)}}$$

$$A = \text{Total orifice circumference} \times (\text{dimention } x)$$

$$\text{Total Circumferences} = (48)(.58905) = 28.27\ \text{in.}$$

$$\text{Total Flow Volume at low fire} = \frac{120}{6} = 20\ \text{ft.}^3/\text{hr.}$$

Therefore:

$$(\text{Dimension } X) \times 28.74 = \left(\frac{20\ \text{ft.}^3}{5400\ \text{ft./hr}}\right)\left(\frac{710}{520}\right)$$

$$\text{Dimension } X = \left(\frac{20}{5400\ \text{ft./hr. (2.395 ft.)}}\right)\left(\frac{710}{520}\right) = .00211\ \text{ft.} = .0253\ \text{in.}$$

Computing velocity across plate 53 at high fire $$\text{Velocity} = \frac{\text{Vol.}}{\text{Area}} = \left(\frac{(120)(144)}{(48)(.02761)(3600)}\right)\left(\frac{710}{520}\right) = 4.945\ \text{ft./sec}$$

In computing the velocity across plate 52 based on tests, good results are obtained when ½ of the flow area is used in plate 52 as plate 53. Therefore, the velocity through the orifices 54 of plate 52 will be 9.89 ft/sec.

Computing the pressure drop across plate 52:

$$\Delta P = \left(\frac{V}{.3977}\right)^2\left(\frac{1}{RT}\right)$$

$$\Delta P = \left(\frac{9.89}{.3977}\right)^2\left(\frac{1}{(60)(710)}\right) = .0142\ \text{inch } H_2O$$

NOTE:
$R$ for the mixture was determined to be 60
Computing the pressure drop across plate 53:

$$\Delta P = \left(\frac{4.945}{.3977}\right)^2\left(\frac{1}{(60)(710)}\right) = .00362\ \text{inch } H_2O$$

Computing the velocity and pressure drop around the perimeter of all orifices 55 at high fire:

$$\text{Flow Area} = \frac{(28.74\ \text{in.})(.0253\ \text{in.})}{144} = .00504\ \text{ft.}^2$$

$$\text{Velocity} = \left(\frac{120}{.00504}\right)\left(\frac{710}{520}\right)\left(\frac{1}{3600}\right) = 9.0\ \text{ft/sec}$$

$$\Delta P = \left(\frac{9}{.3977}\right)^2\left(\frac{1}{(60)(710)}\right) = .01120\ \text{inches } H_2O$$

Computing the diameter of air orifice 17 for secondary air required for combustion:

| | |
|---|---|
| Total Air | = (30 ft.³ gas)(10 ft.³ air/ft.³ gas) |
| | = 300 ft.³ air/hr. |
| 12% excess | 36 |
| Total Air | 336 ft.³/hr. |
| Primary Air | 90 |
| Secondary Air | 246/ft.³/hr. |

$$V = .3977\sqrt{(1)(53.3)(610)}$$
$$V = 71.7\ \text{ft./sec} = 258{,}120\ \text{ft/hr.}$$

$$A = \frac{\text{Vol.}}{\text{Vel.}} = \left(\frac{246}{258{,}120}\right)\left(\frac{610}{520}\right) = .001117\ \text{ft.}^2 = .16099\ \text{in.}^2 \text{ per one ft. of burner assembly 10}$$

Therefore, use two 29/64 inch diameter orifices for a 2 ft. burner assembly. The above calculations are intended only to exemplify the calculations required to determine the design variables discussed, such as orifice diameters and flow rates. Those skilled in the art understand that there are various methods for determining these variables.

It should be understood that while the burner of this invention provides complete flexibility in controlling the gas/air mixture inlet and exit velocity to ports 55 in plate 53, it is not always necessary or desirable for the velocity of the gas/air mixture to be less than the rate of flame propagation at or very near the discharge of ports 55. In some applications, as an example when the burner is used to heat the radiating walls described by U.S. Pat. No. 4,546,553 or U.S. Pat. No. 4,785,552, the flame base can be established slightly below the level of flange 58 of baffle 57, when the burner is operated at or near its highest rated capacity. Therefore, the selection of the number and the diameter of the ports 55 in plate 53 controls where the base of the flame stabilizes with reference to plate 53, from virtually contacting plate 53 to a controlled dimension above plate 53. One advantage in establishing the base of the flame above plate 53 during operation at high energy inputs is that plate 53 will remain cooler if it is not in direct contact with the base of the flame. Even if the base of the flame is established above plate 53 at a high firing rate, the flame base will move closer to or contact the plate during turndown. There are other applications, such as when the burner assembly 10 is operated at lower inputs, when better stability of the flame can be maintained if the base of the flame is in relatively close contact with plate 53.

The diameter of apertures 54 does not have to be the same as the diameter of ports 55. Nor does the number of ports or apertures 54 need to be the same as the number of ports 55. To achieve the desired results produced by this burner assembly 10, there only needs to be an offset between the center line of ports 55 and of ports 54, that prevents alignment of any open area of either ports 54 or 55. Tests have indicated that it is desirable in most instances that the total area of ports 54 in plate 52 be less than the total area of ports 55 in plate 53. Tests have indicated that good results are achieved when the area of ports 54 are ½ of the area of ports 55. This provides for a greater pressure drop across plate 52, therefore, ensuring good distribution of the gas/air mixture through the ports 55 of plate 53.

The fact that the area of the ports 55 increases to the second power of the diameter, while the perimeter only increases to the first power, attributes to the benefit of the design. As a port 55 diameter is increased to provide for a greater discharge area to decrease the velocity of discharge of the gas/air mixture, for a fixed space (dimension 'X') the entrance area to port 55 only increases as the square root of the ratio increase of the discharge area. In a conventional port-type line burner, it is obvious that as the diameter of the port is increased, the area of the entrance and exit of the port are equally affected. While the specific desired flame pattern may vary among applications of the burner assembly 10, the important consideration of this invention is to be able to control the characteristics of the flame pattern. Experiments have been conducted with the diameter of ports 55 of plate 53 ranging from ⅛ inch to 3 inches, with equal success in eliminating backflashing and controlling flame liftoff. A primary advantage of a burner of this invention is that the flame length at high fire can be kept confined (less than 4 inches).

This burner assembly 10 also includes the ability to change the input BTUH by simply changing the orifice diameter 8 and the diameter of the air orifice 17. The air pressure for combustion can also be changed in lieu of an air orifice 17 diameter change or in combination with the orifice 17 diameter change. This flexibility allows one common burner assembly 10 to be rated at different maximum inputs without the need of a design change or a change in the size of burner assembly 10. Tests have been conducted by me wherein the maximum input to the burner assembly 10 ranged from 20,000 BTUH/ft. to 60,000 BTUH ft. with complete and stable combustion throughout the operating range. The maximum input to burner assembly 10 can be changed after it is installed in an application. The gas restricting means 7 can be changed by removing restricting means 7 with a socket wrench. If the requirement is to increase the maximum input, air orifice 17 also can be enlarged. If the requirement is to decrease the maximum input, then a spacer (not shown) containing a smaller opening can be inserted which will effectively decrease the air orifice 17 diameter.

Manifold assembly 11 can be made any length required for the application. It can also be designed in sections to be interconnected with companion flanges (not shown). The combustion air contained within manifold assembly 11 cools assembly 11 and also prevents the gas manifold 18 from becoming overheated when the burner is operated in an environment at a relatively high temperature, such as when the burner is used to directly heat the radiant wall described by U.S. Pat. No. 4,546,553 or by U.S. Pat. No. 4,785,552.

Manifold assembly 11 is mounted to its supPorting surface by brackets 62 which are slotted to provide expansion for the manifold assembly 11. Burner housing 44 mounted to the manifold assembly 11 is allowed to expand and contract independently of manifold assembly 11, since burner housing 44 is connected to manifold assembly 11 near its center. A typical mounting center distance would be 24 inches, with the burner housing 44 lengths slightly less than 24 inches to provide an expansion space between burner housings 44 arranged end to end.

Tests have indicated that reliable and consistent carry-over of the flame from one burner assembly 10 to the next burner assembly 10 exists. For safety reasons, the flame is proven and monitored using conventional flame sensing technology. In a typicial application, an end burner assembly 10 would be ignited with an electrically generated spark or pilot, and the flame on that burner assembly 10 would be sensed and monitored using conventional flame sensing components. If it can be demonstrated that there is consistent carry-over in a continuous length burner, most safety codes do not require that the opposite end of burner assembly 10 be monitored. However, if it were desired or required by the circumstances to not only monitor the initial burner assembly 10 on which ignition occurred, but monitor also the last burner assembly in a series of burners assemblies to ensure that carry-over was absolutely complete to all burner assemblies, a second flame monitoring system could be placed on the last burner assembly. Because of the delay in the flame carry-over from the initial burner assembly which was ignited to the last burner assembly, it usually will be necessary to use some type of timer to delay the energizing of the second flame sensing system.

Figure 6:
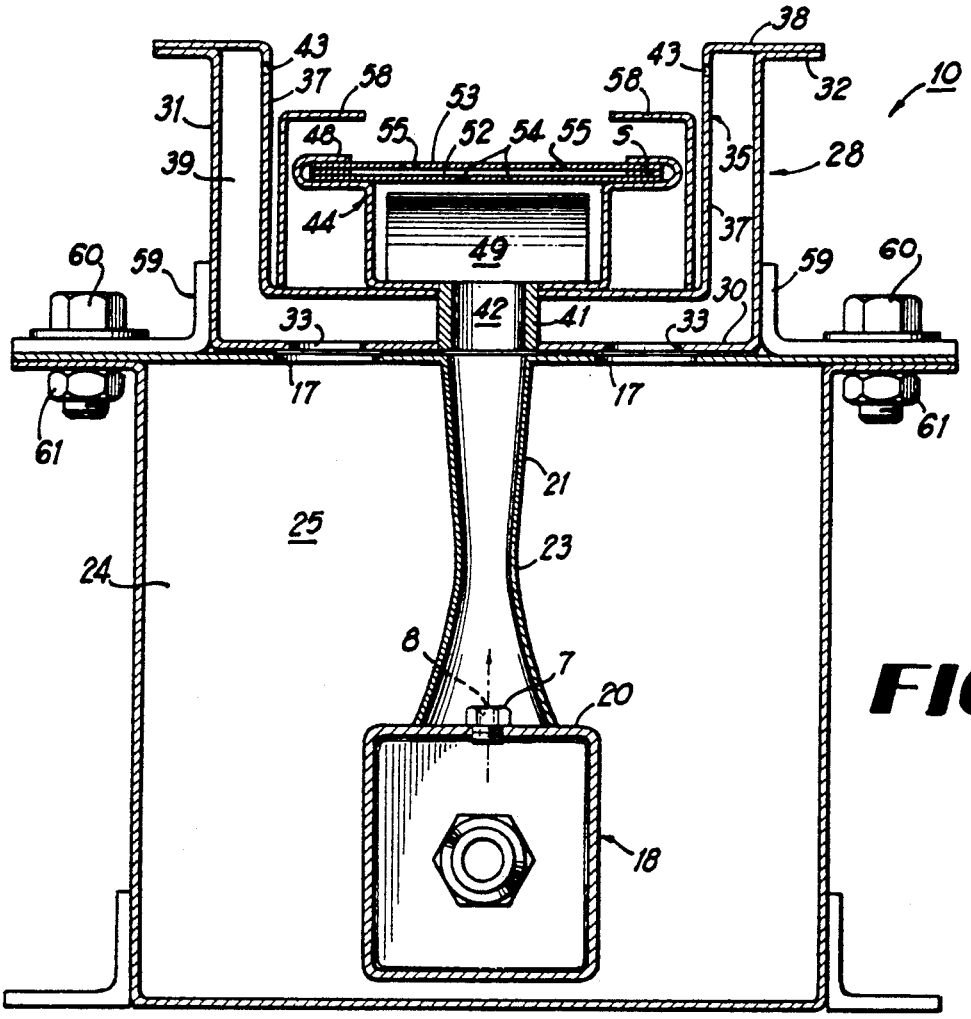
FIG. 6 is a transverse cross-section of an alternate embodiment of the present invention.

A second embodiment of the present invention is illustrated in FIG. 6. In this embodiment, the burner assembly 10 is identical to the assembly previously described, except that in manifold assembly 11, the air orifices 22 in mixing tube 21 are eliminated. Therefore, only gas is delivered through tube 21 to burner housing 44. Air is delivered under pressure through orifices 17 to upper air manifold 28, where all the air for combustion is supplied through ports 43. This embodiment of burner assembly 10 is employed when assembly 10 must operate in environments of extremely high temperature, and auto-ignition of the gas (regardless of the mixture ratio) could occur if any oxygen were present in the burner housing 44. Since, however, all combustion air is supplied by ports 43 at the point of burning, it is impossible for ignition of the gas to occur within the burner housing 44. When nozzle mixing is used, the burner has operated successfully during tests when the combustion surface was exposed to an environment in which the ambient temperature was 1700° F.

Figure 7:
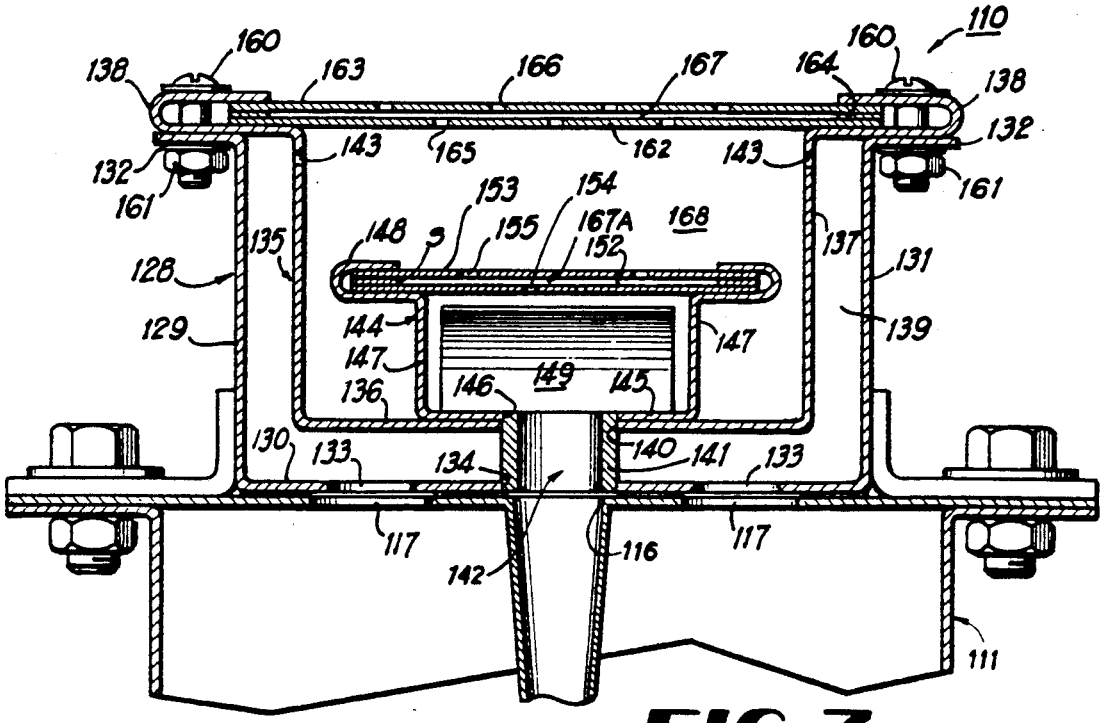
FIG. 7 is a transverse cross-section of another alternate embodiment of the present invention.

FIG. 7 illustrates a third embodiment of the present invention. Burner assembly 110 is mounted to a mixture manifold assembly 111 (shown in fragmentary portion) which is identical in structure and function to manifold assembly 11 described in the second embodiment. Assembly 110 includes air manifold 128 having upstanding, U-shaped outer housing 129 which includes bottom wall 130 and side walls 131 that terminate in laterally extending flanges 132. Bottom wall 130 defines air apertures 133 which communicate with air apertures 117 of the mixture manifold assembly 111. Wall 130 also defines centrally disposed orifice 134 which communicates with the central gas aperture 116 of the mixture manifold assembly 111. Air manifold 128 also includes upstanding, U-shaped inner housing 135 with bottom wall 136 and side walls 137 that terminate in inwardly extending U-shaped retaining flange 138. Flange 132 supports flange 138 so that inner wall 137 is spaced from outer wall 131, and wall 136 is spaced from wall 130, as shown in FIG. 7, to form air chamber 139. Flanges 132 and 138 can either be secured by threaded bolts 160 and nuts 161 or other releasable means, or can be welded or riveted for permanent mounting, as desired. Wall 136 defines central aperture 140 which is aligned with an orifice 134. Tube 141 is welded to walls 130 and 136 around the periphery of apertures 134 and 140, to define passageway 142 therebetween. Along the upper portion of inner wall 137 on each side of air manifold 128 are spaced, air ports 143. Spaced ports 143 extend along the entire lengths of inner walls 137.

Received in retaining flanges 138 are two, spaced, parallel plates, lower plate 162 and upper plate 163. Plates 162 and 163 are held in spaced relationship by spacers 164, which are preferably placed along each side of plates 162 and 163. Plates 162 and 163 therefore, are held in parallel, spaced relationship along their entire lengths, and retained within air manifold 128 within flanges 138.

Plate 162 defines a series of apertures 165 therethrough. Similarly, plate 163 defines apertures or burner ports 166. Apertures 165 and 166 are staggered, or offset in relation to one another so that gas or the gas/air mixture entering apertures 165 must travel laterally between plates 162 and 163 before entering apertures 166.

The space or chamber between plates 162 and 163, denoted generally as numeral 167, has a horizontal dimension Y and vertical dimension X (not shown), identically as illustrated in FIG. 5 regarding the first embodiment. While dimension Y is fixed or constant and cannot be adjusted for a particular burner, dimension X can be varied by utilizing different sized spacers 164.

Supported on bottom wall 136 of housing 135 is gas housing 144. Gas housing 144 comprises bottom wall 145 that defines central orifice 146, which is in alignment with aperture 140. Tube 141 extends to wall 145 and also is welded at its upper end to wall 145 around the periphery of orifice 146. Housing 144 also includes elongate side walls 147 which terminate at their upper ends in inwardly directed, U-shaped retaining flanges 148. Baffle 149 is attached to the upper side of wall 145 and is mounted so that the apex 150 (not shown) extends across orifice 146 and curved arms 151 (not shown) extend in the lateral direction of housing 144.

Received in retaining flanges 148 are two, spaced, parallel plates, lower plate 152 and upper plate 153. Plates 152 and 153 are held in spaced relationship by spacers S, which are preferably placed along each side of plates 152 and 153. Plates 152 and 153 therefore, are held in parallel, spaced relationship along their entire lengths, and retained within burner housing 144 within flanges 148, and so define space 167A therebetween.

Plate 152 defines a series of apertures 154 therethrough, and plate 153 defines apertures 155. Apertures 154 and 155 are staggered, or offset in relation to one another so that gas entering apertures 154 must travel laterally between plates 152 and 153 before entering apertures 155. As seen in FIG. 7, the cooperation of the above-described elements defines mixing chamber 168.

In operation, gas only is delivered to gas housing 144, and air is delivered to air manifold 128 from the mixture manifold assembly 111, identically as that described in the second embodiment. The gas enters gas housing 144 and is laterally distributed by baffle 149. The gas then passes through apertures 154, between plates 152 and 153 and through apertures 155. Plate 153, however, does not constitute the burner surface in this embodiment. Plates 152 and 153 serve to distribute the gas evenly over the surface of plate 153. Orifices 154 are usually less in total number and in diameter than orifices 155. Therefore, the gas is evenly distributed between plates 152 and 153, and emerges from orifices 155 uniformly over the total area of plate 153.

Air enters through orifices 133 into air chamber 139. All of the air for combustion is then discharged into the mixing chamber 168 through orifices 143, where the air mixes with the gas that enters the mixing chamber 168 through orifices 155. If desired, partial premixing of the gas and air can occur in chamber 168 with the remaining air required for combustion provided as secondary air from the atmosphere of the environment in which the burner is located. The gas/air mixture enters space 167 through orifices 165, then flows parallel to plates 162 and 163 and into orifices 166. The mixture velocity entering orifices 166 is controlled by the diameter of orifice 166, which dictates its perimeter, and by the space 167 between the plates 162 and 163. The velocity of the gas/air mixture entering orifice 166 around their perimeters is always greater than the rate of flame propagation, therefore back flashing is precluded as in the prior embodiments. Plate 163 constitutes the combustion surface of the burner 110.

Ey increasing the diameter of orifices 166, the area increases as the square of the diameter, while the perimeter only increases to the first power of the diameter. Therefore, as the diameter of orifice 166 is increased, the area to control flame liftoff is increased at a greater rate than the perimeter, in order to control flashback. Any predetermined space 167 between plates 162 and 163 to control flashback for a specific diameter of apertures 166, will also control flashback as the diameter of orifice 166 is increased, if the flow of gas/air mixture is increased proportionally to the diameter.

The total port or orifice discharge area is determined by the number and diameter of ports 166. An area is used that will result in stable and complete combustion for the operating range of the burner. Since no additional secondary air may be required for combustion beyond the burner surface 163, as is the case of the burner assemblies previously described, it is usually necessary that the total port area of ports 166 be such that the velocity of the gas/air mixture emerging from ports 166 not be much greater than the rate of flame propagation in order to ensure against flame liftoff. The basic concept of the invention, that is, the ability to control the inlet velocity to the discharge port 166 independently of the outlet velocity, is extremely important in this configuration of the burner because a combustible mixture is present in chamber 168. By ensuring that the mixture velocity is greater than the flame propagation at all operating conditions at the entrance to orifices 166, backflashing of the flame into chamber 168 can always be precluded, so long as the temperature of plate 163 stays below the ignition temperature of the gas/air mixture.

Burner assembly 110 requires the modulation of both the gas and air to maintain nearly a constant gas/air ratio through the turndown range. The determination of sizes and numbers of apertures and other design variables is as previously discussed.

Figure 8:
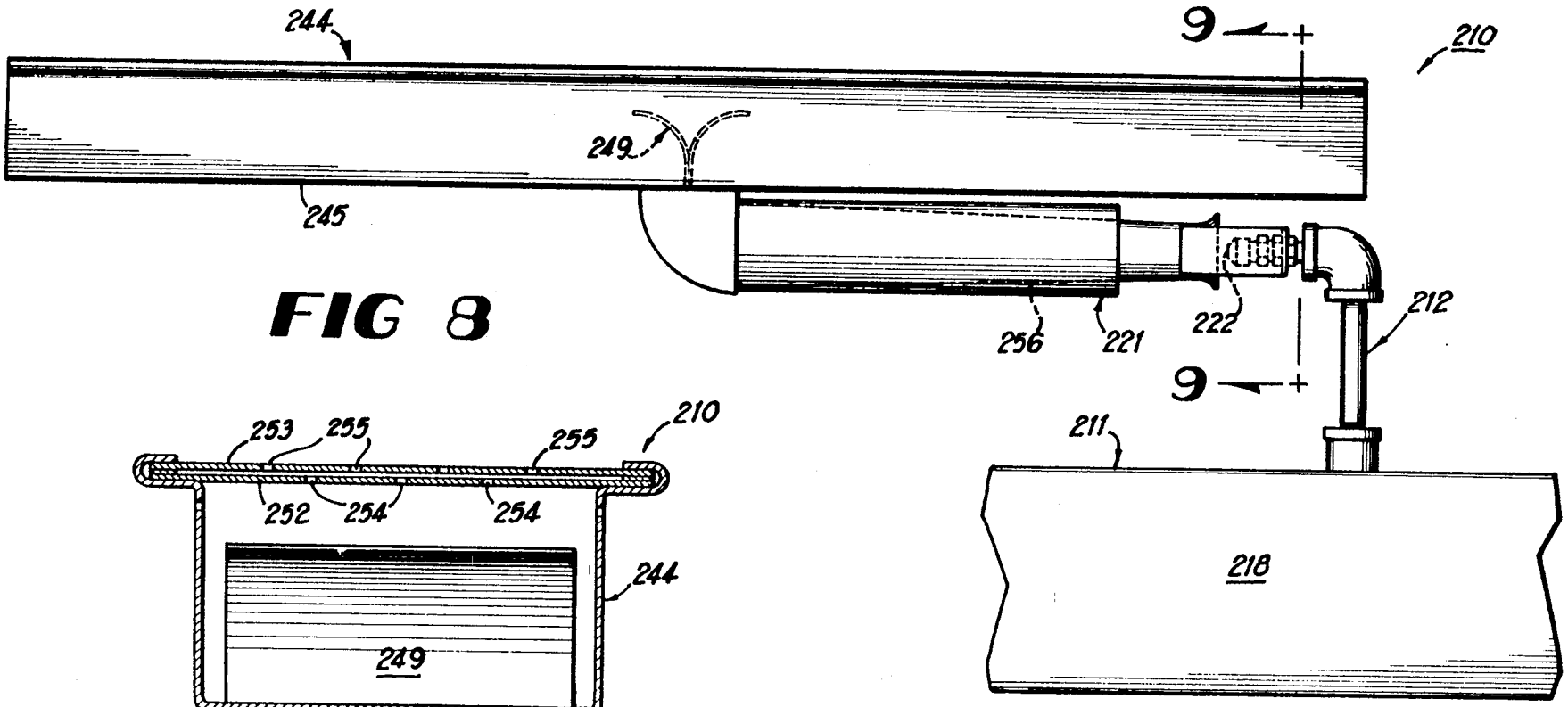
FIG. 8 is a side view of still another embodiment of the present invention.
Figure 9:
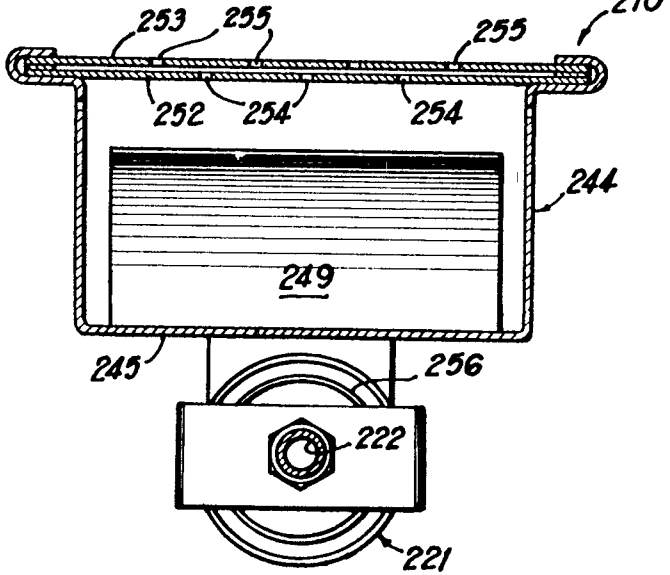
FIG. 9 is a cross-sectional end view taken along lines 9—9 of FIG. 8.
Figure 11:
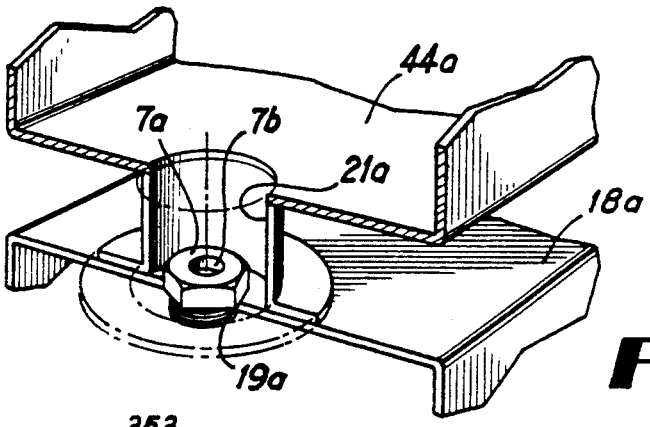
FIG. 11 is a vertical sectional view of still another embodiment of the present invention in which raw gas is burned.

In a fourth embodiment, illustrated in FIGS. 8 and 9, the burner assembly 210 includes a burner housing 244 which is identical in structure and function to housing 44 in FIG. 3. The primary air for combustion is entrained by the venturi 221 and the gas/air mixture is delivered to housing 244. Assembly 211 includes gas manifold or gas line 218, threaded pipe fitting assembly 212 engaged thereto, and venturi assembly 221, which is secured at one end to bottom wall 245 of housing 244. The free end of venturi assembly 221 is in spaced alignment with assembly 212, as illustrated in FIG. 8. A venturi arrangement such as described herein is well known to those skilled in the art, and other known such arrangements will perform satisfactorily. Gas is supplied by line 218 to orifice 222 of assembly 212. The gas is then directed by venturi 221 to housing 244. The primary air for combustion is entrained by the action of venturi 221. The air and gas are mixed while in venturi 221, and are discharged into the burner housing 244. A distribution baffle 249 uniformly distributes the gas/air mixture into housing 244. As in the previous embodiments, parallel plates 252 and 253 containing nonaligned ports 254 and 255 provide the basis for precluding backflashing and flame retrogression. The gas/air mixture enters orifice 254 and then flows parallel to the surfaces and between the plates 252 and 253. The gas/air mixture then enters orifices 255 around their perimeters. As in the previous embodiments, backflashing is precluded by controlling the inlet velocity around the orifice 255 and selecting a diameter and number of orifices or ports 255 to provide a discharge area such that the discharge velocity of the mixture of air and gas from ports 255 can control flame liftoff to a point that ensures stable combustion throughout the operating range of the burner.

In this embodiment, the need for an air manifold such as manifold 28 is eliminated. However, the environment in which the burner assembly 210 is operated must contain oxygen for combustion. Burner assembly 210 could be used in conjunction with incineration, when the atmosphere surrounding burner assembly 210 is essentially a normal atmosphere containing 20% oxygen, but also contains small amounts of volatile organic compounds. Since 100% of the air for combustion is supplied from the surrounding atmosphere, burner assembly 210 is capable of using all of the energy of combustion to heat the air of the surrounding atmosphere, as opposed to requiring its combustion air to be externally supplied.

Where flame length does not impose a restriction to the design, burner assembly 210 can be operated as a raw gas burner with all of the air for combustion supplied as secondary air from the environment. As shown in phantom lines in FIG. 8, the venturi assembly 221 is eliminated, and a straight gas line 256 connects bottom wall 245 of housing 244, and fitting assembly 212. Therefore, gas, only, flows into housing 244. Tests have indicated that complete combustion can be obtained with secondary air only if the combustion space is sufficiently large to allow complete combustion without the flame impinging on any cool surfaces that would have a quenching effect on the flame.

Figure 10:
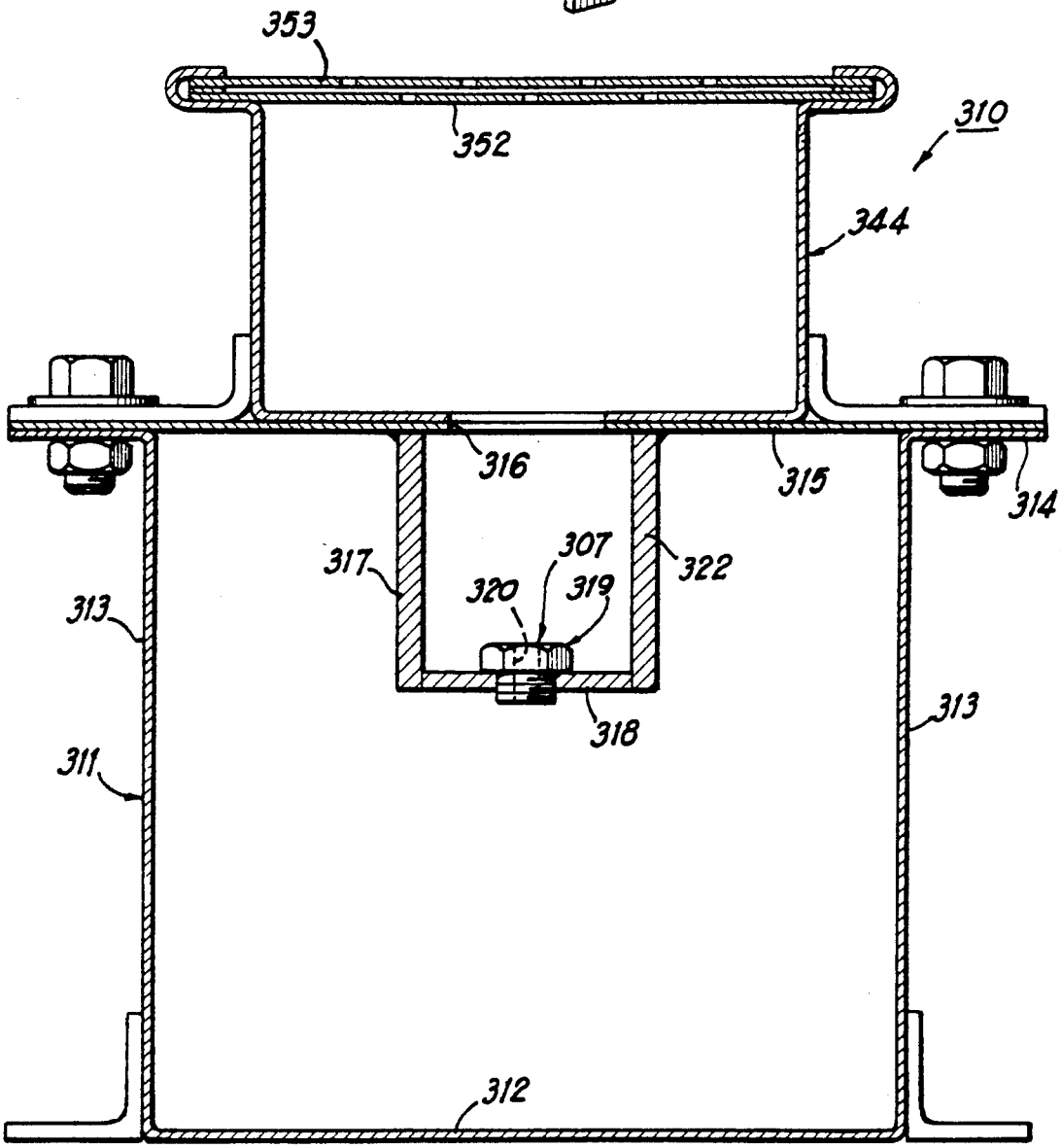
FIG. 10 is a transverse cross-section of another embodiment of the present invention.

A fifth embodiment of the present invention is illustrated in FIG. 10. A burner assembly 310 includes U-shaped mixture manifold assembly 311, having bottom wall 312 and upstanding, side walls 313 terminating in laterally extending flange 314. Plate 315, defining centrally disposed orifice 316, is supported on flanges 314. A tube 322 is welded at its upper end to the bottom side of plate 315 around the periphery of orifice 316, as shown in FIG. 10. Tube 322 includes cylindrical side wall 317 and bottom wall 318. Disposed in bottom wall 318 is threaded mixture restricting member 319 defining orifice 320 therein. Mounted on plate 315 is burner housing 344, which is identical in structure and function to burner housing 44 previously described.

In this embodiment, gas and air are mixed in desired ratio by any common, commercial gas/air mixing device. A premixture of gas/air is supplied to the burner housing 344 through manifold assembly 311. The mixture of gas and air passes through orifice 320 into tube 322. In order to ensure even distribution to all burners attached to manifold assembly 311, a pressure drop of the gas/air mixture is taken across orifice 320, and the mixture is then diffused in tube 322 for entering burner housing 344 through orifice 316. The commercially available gas/air mixers are designed to maintain the proper gas/air ratio throughout the turndown range of burner assembly 310. Once the gas/air mixture enters burner housing 344, it is distributed between plates 352 and 353 and their associated apertures, as previously described with regard to burner housing 44.

More than 20 burner models have been tested employing various combinations of diameters and number of apertures in the plates. In order for the perimeter area to be less than the cross-sectional area of the orifice in the upper plate, for example in the first embodiment orifices 55 in plate 53, the space between the parallel plates must be less than 0.25 times the diameter of the discharge orifice. By experiment, it has been determined that consistent quenching of the flame occurs when the perimeter velocity of the mixture into the discharge port is always greater than 1.2 ft. per second. This is consistent with other studies conducted on flame quenching of mixtures of methane and propane in air. While the space between the parallel plates only needs to be sufficiently thin to affect an area that will ensure a mixture velocity greater than the flame velocity, experiments indicate the thickness of the space between the parallel plates does not need to be greater than 0.050 in. with burner port diameters up to 0.750 in. For small diameters of orifices in the burner surface plate, the space between the plates would have to be decreased, and on some of the experimental burners on which tests have been conducted, excellent results have been achieved by using a separation distance between the parallel plates of 0.020 in.

When the burner is used in conjunction with direct heating of the radiant walls described by U.S. Pat. No. 4,546,533 and U.S. Pat. No. 4,785,552, it is desirable to incinearate the exhaust from the oven. This can be accomplished by using the exhaust air from the oven to provide the secondary air for combustion. If venturis were used to provide the initial premix for combustion, then both the primary and secondary air could be supplied from within the chamber in which the burner is located. In this manner, if exhaust gases were being incinerated, the exhaust gases would make up both the primary and secondary air for combustion. The exhaust air is supplied to the combustion cavity on the inner side of the radiant emitter at a level that will allow good mixing for combustion. Under this operating condition, an exhaust fan (not shown) would be used to exhaust the products of combustion from the combustion zone which would place the combustion space under negative pressure and allow the exhaust air from the oven to be pulled into the combustion zone. Proper controls would ensure that the oven exhaust would remain above incineration temperature of approximately 1250° F. for a dwell time of approximately 0.7 seconds. These conditions will ensure the minimum temperature required for auto ignition of the volatile organic compounds in the exhaust air.

The turndown ratio of the burner assembly 10 when the gas, only, is modulated, is in the order of 6 to 1, which is sufficient in most applications of burner assembly 10. However, a greater range of turndown can be accomplished through modulation or partial modulation of the air along with the gas. If the air is modulated, the lowest air pressure should not be less than would be required to maintain good distribution in the manifold assembly 11. Also, in an application where the products of combustion are to be vented, it could improve the heat transfer efficiency by modulation of the combustion air in combination with the gas, in order to prevent excess air in the products of combustion at low input. As previously discussed, the burner assembly 10 does not require an extensive amount of excess air for efficient and complete combustion, and therefore, air not required for the combustion process would lower the heat transfer efficiency in a vented application by increasing the losses attributed to the flue products. In the cases where the oven or heat transfer process directly utilizes the products of combustion, then efficiency is not affected because the combustion air is usually always less than the make-up air required for the process. Again, since the burner assembly 10 is not sensitive to the gas/air ratio, it provides flexibility in its application for achieving maximum heat transfer efficiency, but allows the use of simple controls by modulating the gas pressure only when heat transfer efficiency is not a consideration.

Most embodiments of the burner assembly 10 of this invention can operate in an oxygen-free atmosphere. Tests have been conducted within an atmosphere primarily consisting of nitrogen and $CO_2$. Under these extreme operating conditions with all of the oxygen for combustion being supplied from the mixture manifold assembly 11 and no oxygen available for combustion from the surrounding environment, the carbon monoxide in the products of combustion has been measured to be less than 200 parts per million. The $CO_2$ in the products of combustion has ranged as high as 11% when burning methane gas, while the CO continued to remain less than 200 parts per million. These tests indicate the capability of the burner assembly 10 to maintain complete combustion without excess air and without the requirement for combustion air that is not supplied through mixture manifold assembly 11. This feature allows burner assembly 10 to operate within a chamber or environment in which all of the oxygen is replaced by carbon dioxide.

The heat transfer efficiency through the radiant wall of my prior art U.S. Pat. No. 4,546,553 has been measured to be greater than 88% when the burner of this invention is used for the heat source. Additionally, the burner assembly 10 can be rotated 360° around the longitudinal axis to any position, with good burner operation.

It will further be obvious to those skilled in the art that many variations may be made in the above embodiments here chosen for the purpose of illustrating the present invention, and full result may be had to the doctrine of equivalents without departing from the scope of the present invention, as defined by the appended claims.

What is claimed is:

1. A burner assembly for burning a combustible mixture of air and fluid comprising:

(a) a pair of opposed inner and outer plates, each said plate including perimeters defining spaced apertures through which said mixture passes, said mixture flowing first through said apertures of said inner plate, then between said plates, then moving past said perimeters of said apertures of said outer plate and into said apertures of said outer plate, said apertures having diameters;

(b) manifold means for introducing said mixture to said apertures of said inner plate;

(c) said plates being spaced a distance apart so that said mixture passing between said plates flows at a velocity, said distance being less than one-fourth of the diameter of one of said apertures of said outer plate, whereby said velocity of said mixture passing said perimeters of said outer plate is sufficiently greater than the mixture velocity through said apertures of said outer plate to prevent retrogression of the flame through said apertures of said outer plate.

2. The burner assembly defined in claim 1, wherein said apertures are from about 1/16 inch (1.6 mm) to about ¼ inch (6.4 mm) in diameter.

3. The burner assembly defined in claim 1, wherein the thickness of each of said plates is between about 0.010 inch and about 0.060 inch.

4. The burner assembly defined in claim 1, wherein as said mixture flows through said apertures of said inner plate, the pressure drop of said mixture through the apertures of said inner plate is less than 0.4 inch of water.

5. The burner assembly defined in claim 1, wherein as said mixture flows through said apertures of said inner plate and into said apertures of said outer plate, the pressure drop of said mixture across both said inner plate and said outer plate is less than 0.6 inch of water.

6. The burner assembly defined in claim 1, wherein said apertures in said inner plate are offset from said apertures in said outer plate.

7. A burner assembly comprising:

(a) a burner housing defining an interior chamber;

(b) a pair of juxtaposed plates positioned over said chamber, one of said plates being an inner plate and the other of said plates being an outer plate extending over said inner plate, said outer plate defining a plurality of spaced burner ports therein, each of said burner ports having a perimeter, said inner plate defining a plurality of spaced apertures offset from said burner ports sufficiently that no portion of said burner ports is aligned with any portion of said apertures, the distance between said inner plate and said outer plate being less than one-fourth of the diameter of one of said burner ports;

(c) supply means for introducing air and a fluid into said chamber under sufficient pressure to provide a positive pressure in said chamber to cause said air and fluid to flow through said apertures and between said plates and past said perimeters of said burner ports at a radial velocity and through said burner ports at an axial velocity; and (d) whereby said radial velocity of said air and fluid past said perimeters of said burner ports is greater than said axial velocity of said air and fluid through said burner ports.

8. A burner assembly comprising:

(a) a pair of plates disposed adjacent to each other for defining therebetween a first chamber, one of said plates being an outer plate defining a plurality of spaced burner ports having perimeters, the distance between said pair of plates being less than one-fourth of the diameter of one of said burner ports;

(b) means for introducing a fluid fuel under pressure into said first chamber for movement at a velocity between said plates and out of said ports at an exit velocity for providing flames burning at or adjacent to said ports; and (c) said plates being sufficiently close together so that said velocity of said fluid fuel around said perimeters of said burner ports is greater than said exit velocity so that retrogression of said flame into said chamber is prevented.

9. The burner assembly defined in claim 8, wherein said plates are flat, elongated, metal members disposed parallel to each other.

10. The burner assembly defined in claim 8, wherein said fluid fuel is a gas fuel and said burner assembly further including means for mixing air with said gas fuel prior to said gas fuel being introduced into said first chamber.

11. The burner assembly defined in claim 10, wherein said air plenum includes portions disposed on opposite sides of said outer plate, said portions of said air plenum defining holes in opposed relationship to each other for feeding air from opposite sides of said outer plate over the surface of said outer plate.

12. The burner assembly defined in claim 8, wherein said other of said plates is an inner plate, said means for introducing fluid fuel into said chamber including a burner housing adjacent to said inner plate, said burner housing and said inner plate defining a second chamber within said housing, and said inner plate being provided with a plurality of apertures which are offset from said burner ports, said fluid fuel being fed into said second chamber and then through said apertures into the first chamber and, thereafter, laterally in said first chamber for exiting through said burner ports.

13. The burner assembly defined in claim 12 including an air plenum into which air under pressure is introduced, and means for directing air from said air plenum into said second chamber for admixing with said fluid fuel.

14. The burner assembly defined in claim 13 further comprising fuel conduit means communicating with said second chamber for directing the flow of said fluid fuel to said second chamber and means for admixing air with said fluid fuel as said fluid fuel flows toward said second chamber.

15. The burner assembly defined in claim 13, wherein said means for admixing air with said fuel includes orifices intermediate the ends of said conduit means for permitting air to pass from said air plenum into said conduit means.

16. The burner assembly defined in claim 8, wherein said outer plate is a flat elongated member and wherein said burner ports are equally spaced in alignment throughout substantially the length of said outer plate.

17. The burner assembly defined in claim 8, wherein said outer plate is an elongated flat rectangular metal sheet and wherein said burner ports are arranged in parallel rows extending throughout substantially the length of said outer plate, said rows being spaced inwardly from the opposite edges of said outer plate.

18. The burner assembly defined in claim 8, wherein said other plate is an inner plate which is provided with a plurality of apertures extending along the length of said inner plate, and wherein said burner ports are arranged in a longitudinal row which is laterally spaced from said apertures, the fluid fuel being introduced to said apertures in said inner plate.

19. The burner assembly defined in claim 18, wherein said apertures are arranged in parallel rows along the length of said inner plate, said burner ports being arranged in parallel rows which are disposed inwardly of the rows of apertures in said inner plate.

20. A burner assembly for creating a flame by burning a combustible fluid, comprising a burner plate defining a plurality of spaced burner ports having perimeters, an inner plate disposed beneath each of said burner ports and extending laterally beyond said perimeters of said burner ports, said inner plate spaced from said burner plate a distance of less than one-fourth of a maximum distance across one of said burner ports, and fluid supply means for delivering the combustible fluid between said burner plate and said inner plate and radially past said perimeters of said burner ports and axially through said burner ports, whereby said inner plate is sufficiently close to said burner plate that said radial velocity of said fluid is greater than said axial velocity of said fluid to prevent said flame from retrogressing between burner plate and said inner plate.

21. A gas burner assembly comprising:

(a) a burner housing having a chamber therein;

(b) means for supplying a combustible gas under pressure to said chamber; and (c) juxtaposed outer and inner, laterally extending plates disposed over said chamber, each of said plates defining apertures, said apertures of said outer plate being entirely offset from said apertures of said inner plate, said plates being spaced from each other sufficiently for said combustible gas to pass from said chamber through said apertures of said inner plate, then to pass laterally between said plates at a first velocity and, thereafter, outwardly through said apertures of said outer plate at a second velocity for producing flames adjacent said apertures when said combustible gas passing outwardly through said apertures of said outer plate is ignited, said plates being sufficiently close to each other that the said first velocity around said perimeters of said apertures of said outer plate is greater than said second velocity, preventing retrogression of said flames into said chamber and the distance between said outer and inner plates is less than one-fourth of a maximum distance across one of said apertures of said outer plate.

22. Process of burning fuel to produce heat, comprising:

(a) disposing a first plate and a second plate adjacent to each other to define therebetween a first chamber, said first plate and said second plate each defining spaced apertures therethrough, said apertures of said first plate being misaligned with said apertures of said second plate and having diameters, the distance between said first plate and said second plate being less than one-fourth of the diameter of one of said apertures of said second plate;

(b) passing a combustible fuel through the apertures of said first plate and into said first chamber under sufficient pressure that said fuel moves at a first velocity laterally in said chamber away from said apertures of said first plate and toward and through said apertures of said second plate for emerging at a second velocity from said apertures of said second plate;

(c) controlling said first velocity of said fuel in said chamber around said perimeters of said apertures of said second plate so that said first velocity of said fuel around said perimeters of said apertures of said second plate is greater than said second velocity of said fuel emerging from said apertures of said second plate; and (d) igniting said fuel emerging from said apertures of said second plate.

23. The process defined in claim 22 including mixing air with said fuel, prior to said fuel being passed through the apertures of said first plate and into said first chamber.

24. The process defined in claim 23 including varying the rate of flow of said fuel while maintaining the rate of flow of said air at a constant to thereby increase and decrease the yield of said burner.

25. The process defined in claim 24 including the step of directing secondary air under pressure toward said apertures in said second plate for admixing the secondary air with the combustible gas/air mixture emerging from said apertures of said second plate.

26. The process defined in claim 25 in which said air is introduced from opposite sides of said apertures of said second plate and is directed inwardly toward the paths of the gas emerging from the holes of said second plate.

27. The process defined in claim 22, wherein said fuel is gas and including providing a second chamber adjacent to a side of said first plate opposite to said first chamber, and passing air and said gas under pressure into said second chamber, prior to the time that said gas is passed through the apertures of said first plate and into said first chamber.

28. The process defined in claim 22 including disposing a second chamber adjacent to said first plate, introducing air into said second chamber, mixing air from said second chamber into said fuel passing into the first-mentioned chamber for producing a combustible mixture within said first-mentioned chamber.

29. The process defined in claim 28 including the step of disposing a third chamber adjacent to but spaced from said second chamber and providing a communication between said second chamber and said third chamber for the passage of air to the fuel passing into said second chamber.

* * * * *